US007168843B2

(12) United States Patent
Striebel

(10) Patent No.: US 7,168,843 B2
(45) Date of Patent: Jan. 30, 2007

(54) MODULAR LIGHTING BAR

(75) Inventor: Roman F. Striebel, Duxbury, MA (US)

(73) Assignee: Suncor Stainless, Inc., Plymouth, MA (US)

( * ) Notice: Subject to any disclaimer, the term of this patent is extended or adjusted under 35 U.S.C. 154(b) by 243 days.

(21) Appl. No.: 10/834,725

(22) Filed: Apr. 29, 2004

(65) Prior Publication Data

US 2005/0141225 A1 Jun. 30, 2005

Related U.S. Application Data

(63) Continuation-in-part of application No. 10/755,516, filed on Jan. 12, 2004, which is a continuation-in-part of application No. 09/968,560, filed on Oct. 1, 2001, now Pat. No. 6,676,278.

(60) Provisional application No. 60/237,012, filed on Sep. 29, 2000.

(51) Int. Cl.
*H01R 33/00* (2006.01)

(52) U.S. Cl. ..... 362/652; 362/647; 362/365; 362/382

(58) Field of Classification Search ..... 362/382, 362/249, 365, 362, 364, 145, 146, 576, 640, 362/647, 652, 659; 248/904, 906, 915; 439/419

See application file for complete search history.

(56) References Cited

U.S. PATENT DOCUMENTS

| | | | | |
|---|---|---|---|---|
| 4,152,624 | A | 5/1979 | Knaebel | 313/499 |
| 4,190,976 | A | 3/1980 | Hurt | 43/17.5 |
| 4,574,337 | A | 3/1986 | Poppenheimer | 362/267 |
| 4,597,033 | A | 6/1986 | Meggs et al. | 362/183 |
| 4,744,014 | A | 5/1988 | Harris | 362/145 |
| 4,758,934 | A | 7/1988 | von Kohorn | 362/145 |
| 5,036,442 | A | 7/1991 | Brown | 362/102 |
| 5,045,981 | A | 9/1991 | Nagano | |
| 5,068,773 | A | 11/1991 | Toth | 362/386 |
| 5,083,192 | A | 1/1992 | Rzeznik et al. | 357/74 |
| 5,130,909 | A | 7/1992 | Gross | 362/153 |
| 5,211,469 | A | 5/1993 | Matthias et al. | 362/101 |
| 5,222,799 | A | 6/1993 | Sears et al. | 362/146 |
| 5,264,997 | A | 11/1993 | Hutchisson | 362/226 |
| 5,349,509 | A | 9/1994 | Klug | |
| 5,450,299 | A | 9/1995 | Lepre | |
| 5,632,551 | A | 5/1997 | Roney et al. | 362/249 |
| 5,701,236 | A * | 12/1997 | Viviano | 362/576 |
| 5,771,617 | A | 6/1998 | Baker | 40/544 |
| 5,779,228 | A | 7/1998 | Hansen | |

(Continued)

*Primary Examiner*—Sandra O'Shea
*Assistant Examiner*—Bao Q. Truong
(74) *Attorney, Agent, or Firm*—Jacob N. Erlich; Burns & Levinson, LLP

(57) ABSTRACT

Modular lighting bar mountable on a surface into which may be mounted one or more miniature light sources and an electrical supply line. The light sources can include light emitting diodes. The lighting bar has alternative single and two-component configurations that fix the position of the electrical supply line, and may be formed with a recess that receives an asymmetrically shaped electrical supply line in only one possible orientation. The ends of the lighting bar include mateable features for connecting additional bars. The bars may include recesses for receiving rigid members such as railing balusters, and optionally rotatable plugs to allow adaptation of the mounting bars to fit stair case railings with lighting and/or balusters.

54 Claims, 27 Drawing Sheets

U.S. PATENT DOCUMENTS

| | | | | |
|---|---|---|---|---|
| 5,829,865 | A | 11/1998 | Ahroni | |
| 5,842,779 | A | 12/1998 | Siebert | 362/309 |
| 5,876,109 | A | 3/1999 | Scalco | 362/104 |
| 5,927,845 | A | 7/1999 | Gustafson et al. | 362/152 |
| 6,069,447 | A | 5/2000 | Vilanilam et al. | |
| 6,135,621 | A | 10/2000 | Bach et al. | |
| 6,241,361 | B1 | 6/2001 | Thrasher et al. | |
| 6,265,834 | B1 * | 7/2001 | Lin | 362/249 |
| 6,415,732 | B1 | 7/2002 | Delorenzo | |
| 6,676,278 | B2 | 1/2004 | Striebel et al. | |
| 7,052,170 | B2 | 5/2006 | Striebel | |

* cited by examiner

MODULAR LIGHTING BAR

CROSS REFERENCE TO RELATED PATENT APPLICATIONS

This application is a continuation-in-part of U.S. patent application Ser. No. 10/755,516 entitled "Super Bright LED Utility And Emergency Light", filed Jan. 12, 2004, which is a continuation-in-part of U.S. patent application Ser. No. 09/968,560 filed Oct. 1, 2001 now U.S. Pat. No. 6,676,278, which claims priority of U.S. Provisional Application Ser. No. 60/237,012 entitled "Super Bright LED Utility And Emergency Light", filed Sep. 29, 2000, all of the above are herein incorporated by reference in their entirety.

FIELD OF THE INVENTION

The present invention relates generally to electrical lighting and, more particularly, to easily installed recessed lighting for use with railings and similar structures.

BACKGROUND OF THE INVENTION

Average homeowners, and even semi-skilled construction workers, find conventional railing systems nearly impossible to install. Specialized installation knowledge and the present need for a variety of fittings have made standardization prohibitively expensive and mass marketing infeasible. These problems are compounded when in railings installations on staircases such as, for example, on decks where electrical lighting is also desirable. There are too many variables to make existing systems easy to install, as there are a wide variety of fittings from which selections can be made, some of which require further modification to allow them to be used. Presently, the scope of installations on stairs requires considerable knowledge, far beyond that of the average homeowner or general contractor.

There is a well-established general trend and desire for homes and commercial structures to be largely maintenance free. This has spurred the use of recycled plastic, PVC and other materials in decking and other residential and commercial building projects. Accordingly, an objective of the present invention is to introduce maintenance-free deck lighting and railing systems that can be successfully installed by a novice using simple tools.

Miniature illumination lighting devices have historically used incandescent or halogen bulbs. These types of lighting systems are relatively inefficient. A substantial amount of energy is lost generating heat as a byproduct. Another disadvantage of these types of systems is the relatively short life span of the lighting bulbs. Consequently, these lighting systems result in high operational and maintenance costs. The problems associated with past miniature illumination systems have, in part, been solved by illumination devices of the type disclosed in commonly-assigned U.S. patent application Ser. No. 10/755,516, entitled "Super Bright LED Utility And Emergency Light."

There remain problems relating to the costs and adaptability of light emitting diodes (LED's) to electricity supply lines in structures such as, for example, new and existing railing systems. Thus, another objective of the present invention is to provide versatile, adaptable, inexpensive lighting systems employing miniature light sources, such as, for example, LED's that are easy to install in such systems.

SUMMARY OF THE INVENTION

The present invention provides a modular lighting bar that is durable, inexpensive and yet versatile and easy to install. The lighting bar includes miniature light assemblies recessed within a mounting bar so as to expose no wiring externally. Although the modular lighting systems may be employed in a wide variety of applications, they are especially useful in providing illumination to railing systems. The lighting system allows quick, easy connection between miniature light sources such as, for example, light emitting diodes (LEDs) and electric supply lines.

In certain embodiments, the modular lighting bar has at each of its ends a mateable connector, such as male and female dovetail connectors. This allows multiple lighting bars to be hooked together to accommodate any length project that requires lighting.

These and other objectives are achieved by a plurality of LED lights mounted in suitable recesses (hollowed out volumes) inside a mounting bar. Each LED is contained in a light housing that has two prongs protruding from its back, one of which is positive and the other negative. The light housing is shaped in such a way as to allow it to be inserted into the mounting bar recess in only one possible way, thus ensuring that the positive prong and the negative prong are always in exactly the same position.

In a first embodiment, the mounting bar has a lengthwise notch or groove for mateably receiving a specially shaped supply housing designed in such a way as to firmly hold an electrical supply line. A preferred, commercially available supply line is comprised of one positive and one negative lead each surrounded by differently-shaped flexible molded plastic segments; one segment rounded and the other square so as to identify the positive and the negative leads. The supply housing includes a lengthwise recess shaped to accept the asymmetric supply line in only one possible orientation, thus ensuring that the positive lead and negative are always arranged in the same position. This allows the supply line to be aligned with the prongs of the light source(s), so as to maintain proper polarity. In certain embodiments, the light source prongs are designed to penetrate the outer plastic of the supply line to connect directly to the positive and negative leads within. This can be achieved by beveling or sharpening the prong ends to be sharp. Alternatively, the end of each prong may terminate in a small blade fixture for better penetration of the electrical supply line.

In another embodiment, the groove in the mounting bar is narrower at the surface of the bar, and wider towards the interior of the bar. For example, an inverted "T" shape in the mounting bar can be used to properly align and secure the asymmetric electrical supply line, eliminating the need for a mateable supply line housing component.

Each miniature light assembly preferably, but not necessarily, comprises an LED light source as described in commonly assigned and co-pending patent application Ser. No. 10/755,516 entitled "Super Bright LED Utility and Emergency Light", the contents of which are incorporated herein by reference. In such light assemblies, the negative prong incorporates an insulated wire directly connected to the light source, while the positive prong incorporates an insulated wire connected to the light source by a resistor. In each light assembly, sealant is disposed within the light housing affixing the relevant position of the positive and negative prongs and the light source. The sealant prevents any water or moisture from reaching the electrical connections of the light assembly. The light housing is shaped so as to surround and protect the light source without allowing the sealant to reach or coat the light source.

The present invention requires only one continuous electric supply line, and LED connections are made to that supply line by pushing the LED into its specially shaped recess, and thus forcing the prongs (or optional blade fixtures connected thereto) to puncture the plastic coating of the electric supply line and make a direct connection. This eliminates significant electrical work, usually required with standard lights having two leads protruding from them and therefore requiring individual electric connections to those. The use of uniform orientation of the electrical supply line alternatively throughout the supply housing and/or in the mounting bar groove ensures that the same electric supply line from the power source can be used throughout the installation without concern over reorientation each time a light is to be connected. The supply line can be easily twisted through holes in posts, plates, stanchions or similar supports, but regardless of such contortions will still be aligned properly in the supply housing with respect to the lights source prongs or conductive blade leads. This is especially important with LEDs, which function only with proper polarity.

The use of a single electrical supply line provides the maximum flexibility to mount LED lights anywhere along the housing, and enables use of differently shaped mounting bars that conform with the design of the structure (e.g., railing system) within which it is employed. This allows application of the lighting bars in both new and existing retrofit railing systems, regardless of the construction of those railing systems, and further permits use of the present invention for many other applications not mentioned herein, provided the mounting bar and/or supply housing bar can be mounted to a surface of a structure.

The mounting bar has through-holes disposed either horizontally or vertically to allow fastening to any surface through any conventional fastening means (e.g., screws, bolts, nails, etc.) In both the two-component lighting bar (i.e., having a mated mounting bar and supply housing) and single-mounting bar configurations, a nearly seamless and water-tight assembly is formed for conveying electrical power to a plurality of recessed, miniature light sources. Alternatively, the mounting bar may be fastened to the desired surface by means of an adhesive, eliminating the need for fasteners and through-holes.

In a preferred embodiments, the single-mounting bar or mated two-component lighting bar also serve as supports for a handrail, in which a groove or channel may be formed to receive the assembly.

In yet another embodiment, the modular lighting bar may additionally be used to hold rods and tubes such as, for example, railing balusters in both horizontal and vertically sloping railing configurations. In such configurations, substantially identical top and bottom lighting bars additionally have a series of recesses suitably shaped to securely hold solid bars or hollow tubing that form railing balusters or spindles. The electrical supply line recess is offset from the baluster-holding recesses to prevent interference between the low voltage installation and any metal surface of the balusters.

In order to accommodate sloping staircase railings, the lighting bars may additionally be configured with a plurality of rotating plug recesses corresponding to and oriented at 90 degrees to the baluster-holding recesses that each internally connect to the baluster-holding recesses. In these recesses are disposed plugs that have features such as holes or flanges to receive the end of the baluster and that rotate so as to allow the baluster to pivot within the baluster-holding recess. The baluster-holding recesses in the mounting bar, of course, should be elongated to allow such pivoting, and are preferably located on the side of the mounting bar opposite the side receiving the electrical supply line. The elongated holes and pivoting plugs allow the lighting bar to be employed in securing balusters at up to 45 degree angles, thus allowing use in a wide variety of stair angles.

BRIEF DESCRIPTION OF THE FIGURES OF THE DRAWING

For a better understanding of the present invention, together with other and further aspects thereof, reference is made to the accompanying drawing and detailed description, wherein.

DETAILED DESCRIPTION OF PREFERRED EMBODIMENTS OF THE INVENTION

Figure 1:
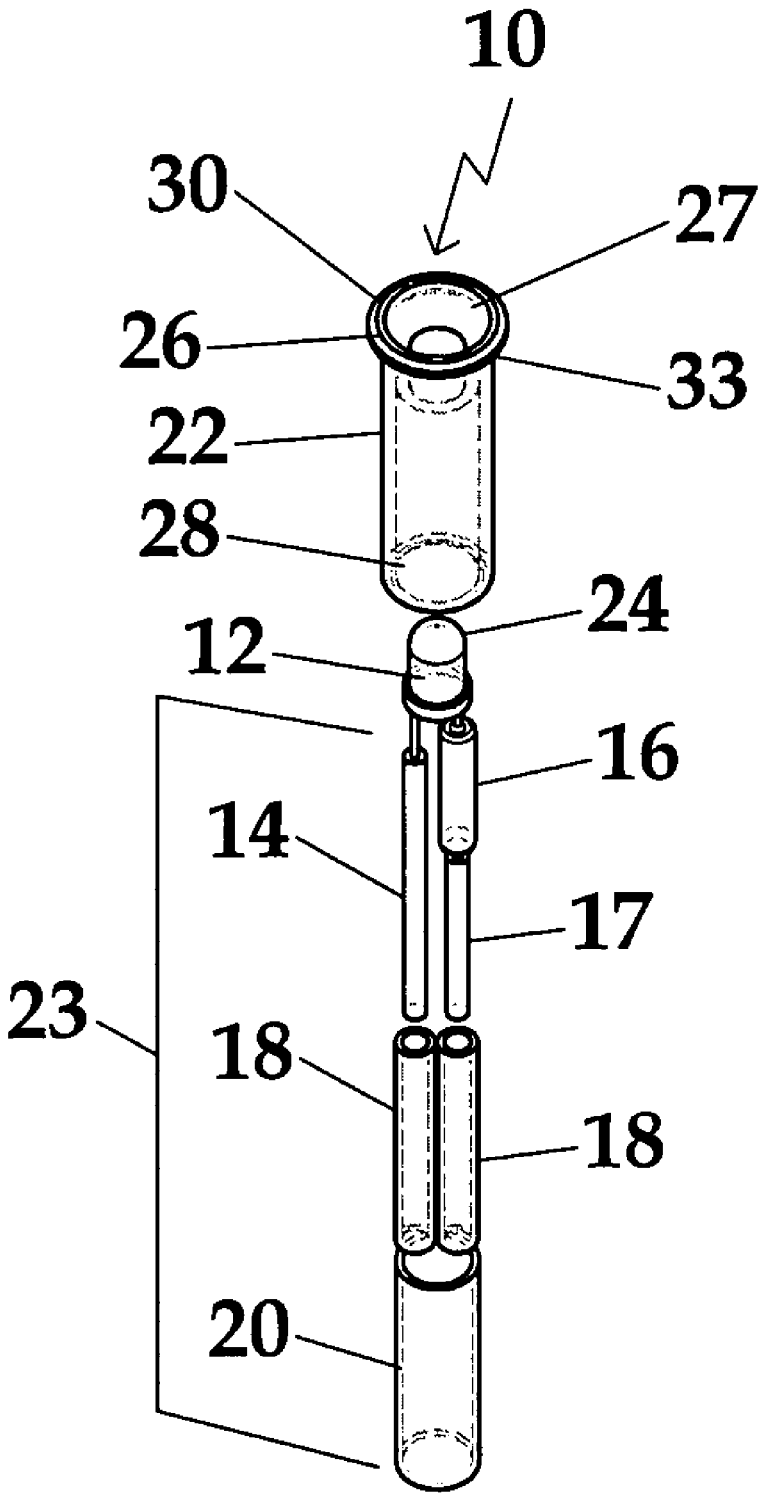
FIG. 1 is an exploded pictorial view of a miniature lighting assembly such as might be employed in the present invention.
Figure 2:
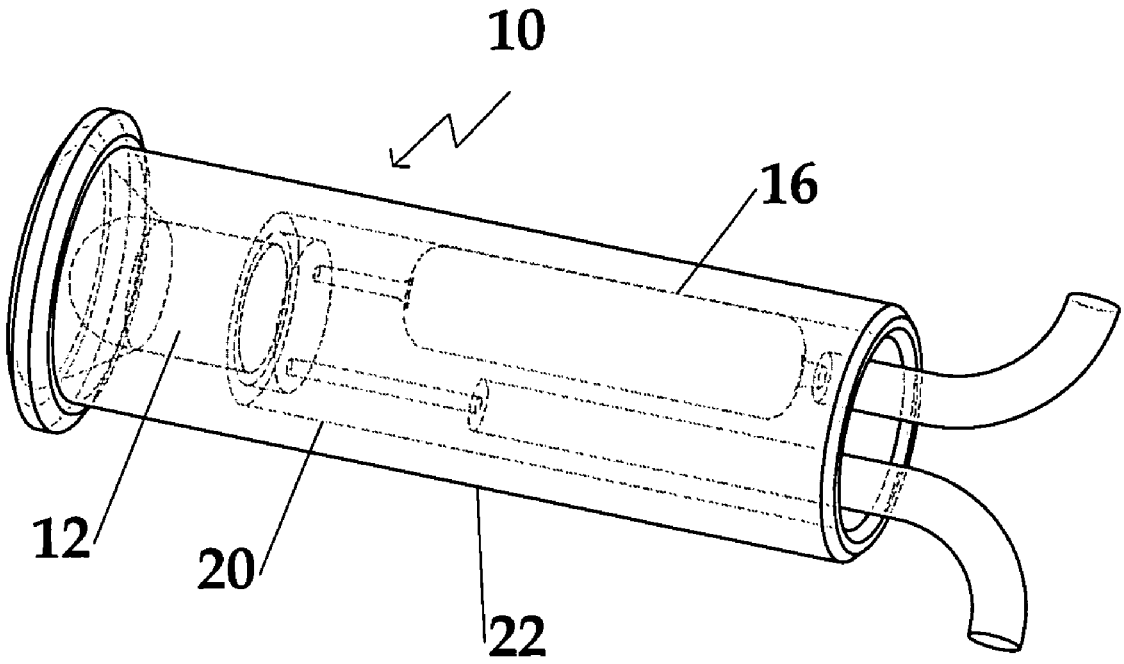
FIG. 2 is a pictorial side view of the miniature lighting assembly.

With reference to FIGS. 1 and 2, a non-limiting example of miniature light assemblies 10 that may be employed in the lighting bar of the present invention includes a bright LED 12, an electric insulated wire having a negative lead 14 connected to the LED 12, a resistor 16 connected to the LED 12, and an electric insulated wire having a positive lead 17 connected to the resistor 16. Note that the wires are preferably insulated, specifically to allow use of metal components, but if the components of the lighting bar are formed of a non-conductive material such as plastic the need to insulation disappears. The term "wire" as used herein refers to a conductive material having sufficient strength and rigidity to puncture the plastic coatings found on conventional electrical supply lines. The portion of the wires protruding from the housing are referred to interchangeably below as 'prongs' or 'leads', and they may include tapered or beveled ends to facilitate the puncturing of the electrical supply line coatings. The resulting LED connections may be covered by a small, inner piece of shrink-tube 18 after which the complete component assembly 23 is covered by an outer shrink-tube 20, which all together prevent any electrical component from touching housing 22, preferably composed of stainless steel or another sturdy material.

The electrical component assembly 23 is then inserted into the housing 22. As shown in FIG. 1, one embodiment of the housing 22 comprises of a top portion 26, which includes a flat area 30, an inside chamfered surface 27 and a housing shoulder 33, and a bottom portion 28. The housing 22 is stepped in such a way that only the dome 24 of the LED fits through the top portion of the housing 26 and the electrical component assembly 23 is contained in the bottom portion of the housing 28. Once inside the housing 22, the assembly 23 may be surrounded with a commercially available sealant such as epoxy or silicon sealer to prevent any water or moisture from reaching the resistor 16 or connections, but without the sealant being able to reach or coat the LED 12 lens. Furthermore, the housing 22 is machined or molded so that the top portion of the housing 26 surrounds and protects the LED 12 against damage. Additionally, when using a metal housing 22, the inside chamfered surface 27 and the flat area 30 are polished after machining so as to enhance the reflective light of the LED 12. The finished lighting assembly 10 is connected to a desired power source near the bottom portion of the housing 28 by means of the electrical wires/prongs 14, 17. Other miniature light sources, including non-LED light sources and LED light sources with different housings are deemed to be within the scope of the present invention.

Figure 3:
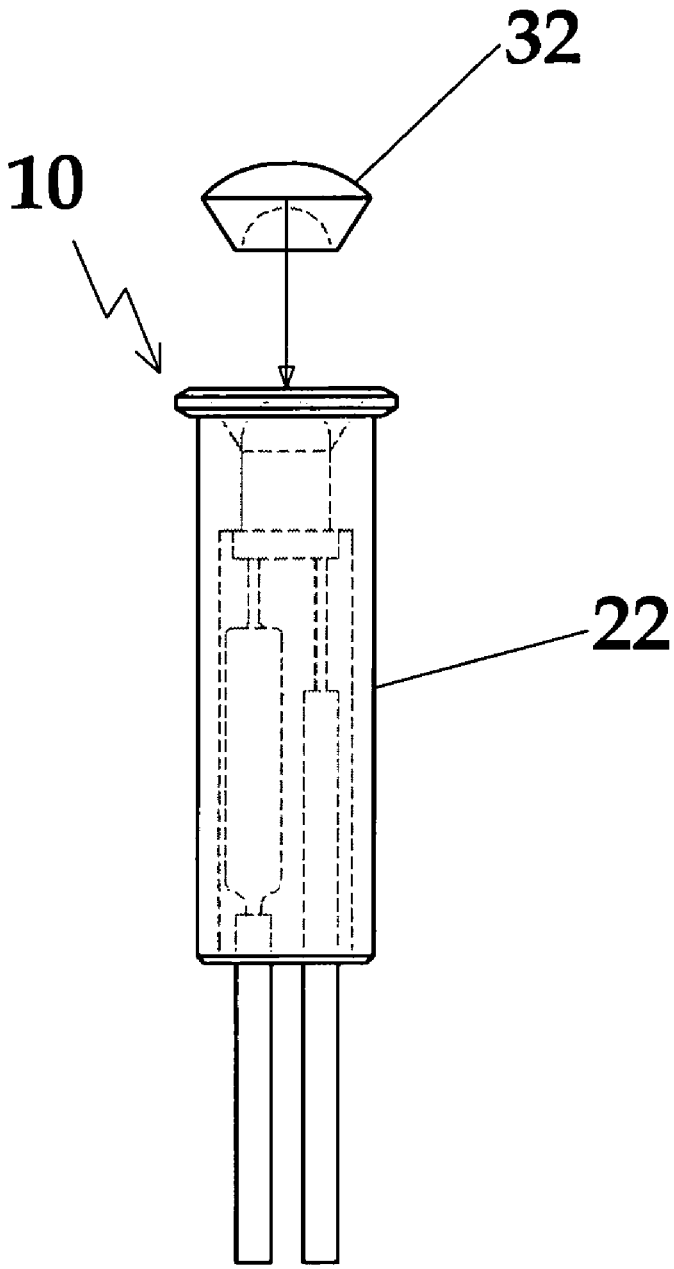
FIG. 3 is an exploded side view of the miniature lighting assembly with a cap that permits a diffused light pattern.

With reference to FIG. 3, in another embodiment of the miniature light assembly 10, a machined or injection molded cap or diffusing lens 32 is affixed to the top portion 26 of the housing 22, thus providing a "softer", diffused light source and wide-angle coverage as opposed to the point of light generated by the uncovered LED 12.

Since the lighting assemblies 10 are very small (e.g., the outside diameter of the housing 22 may be as small as ¼"), the assemblies 10 can be directly and without other parts mounted in practically any natural and synthetic material, such as wood, fiberglass, glass, metal, stone, plastics, concrete, plasterboard, and other such materials. As described in an embodiment below, the housing 22 may simply be inserted into a hole or recess formed in a mounting block. The recess in the mounting block is preferably shaped to receive the light assembly in only one orientation, thus ensuring that the positive and negative leads of the light assembly are properly positioned with respect to an electrical supply line within the mounting block. The light assembly may be secured in the recess by dimensioning the recess such that the light assembly fits snugly in the recess, or through other purely mechanical means such as, for example, a grommet. A sealant, such as epoxy or silicon sealer may be additionally applied to secure the light assembly in the recess, bearing in mind that the light assembly will need replacement at the end of its useful life.

Figure 4A:
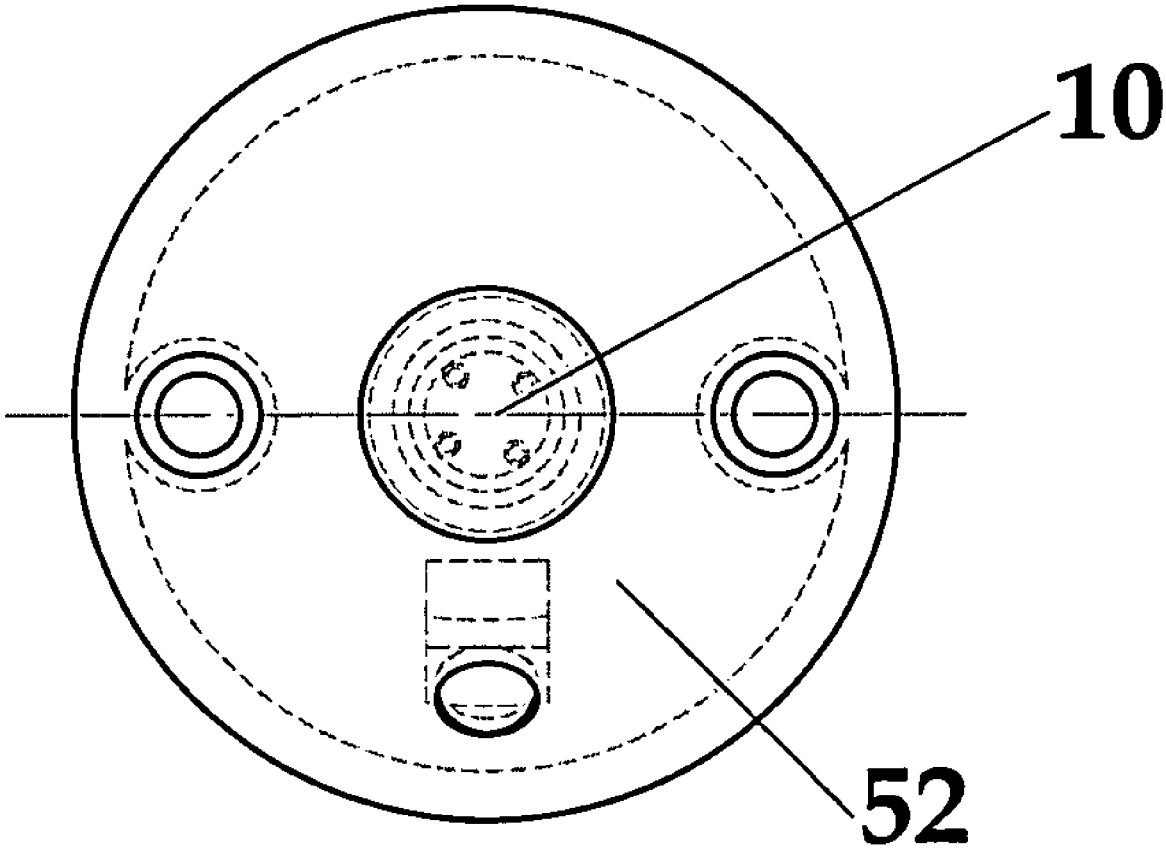
FIG. 4*a* is a pictorial top view of a surface mounted, unitized housing containing several miniature lighting assemblies.
Figure 4B:
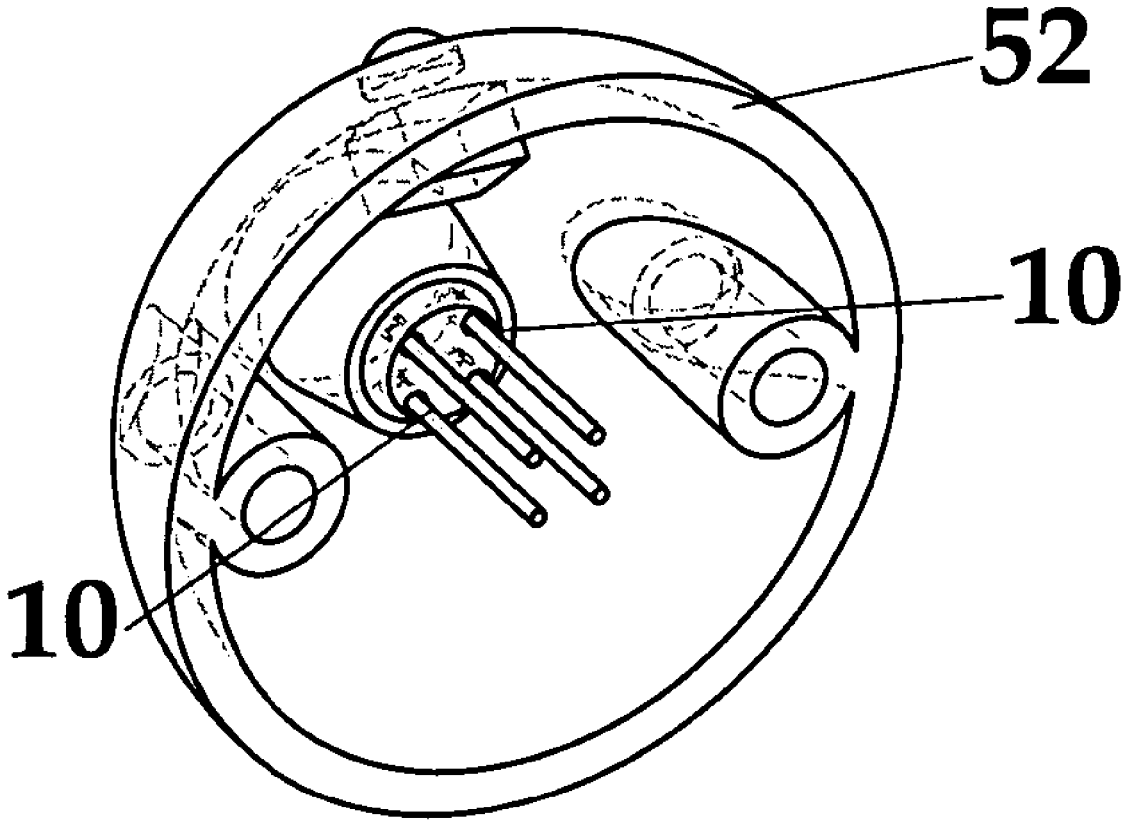
FIG. 4*b* is a pictorial bottom view of a surface mounted, unitized housing containing several miniature lighting assemblies.
Figure 4C:
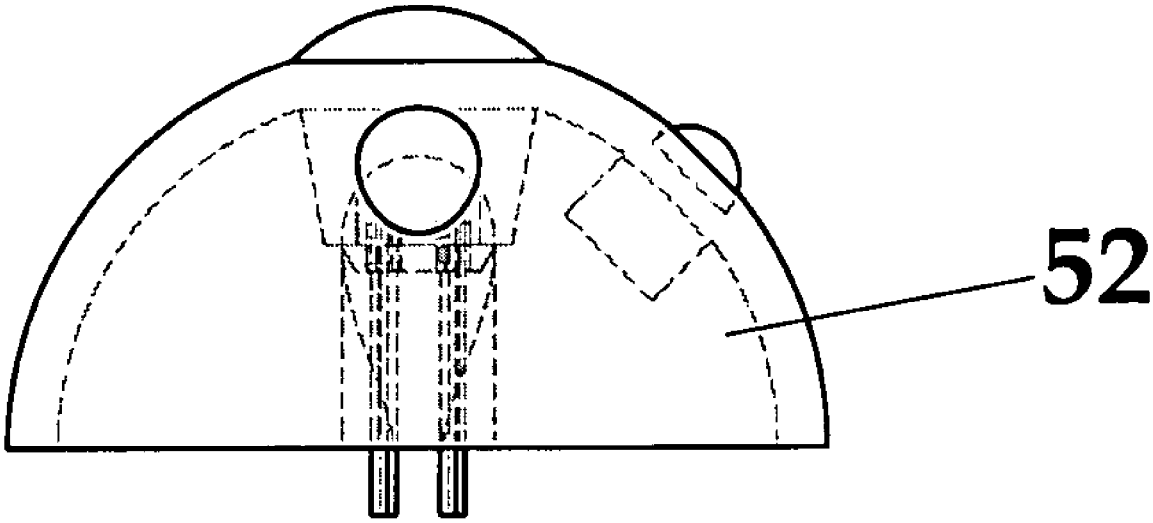
FIG. 4*c* is a pictorial side view of a surface mounted, unitized housing containing several miniature lighting assemblies.

With reference to FIGS. 4*a–c*, the miniature light assemblies 10 may also be aggregated to provide a more intense illumination. Several miniature light assemblies 10 may be grouped together within a single, unitized, environmentally sealed housing 52. The unitized housing 52 may be surface mounted or recessed and may also include a switch within the unitized housing 52.

Figure 5A:
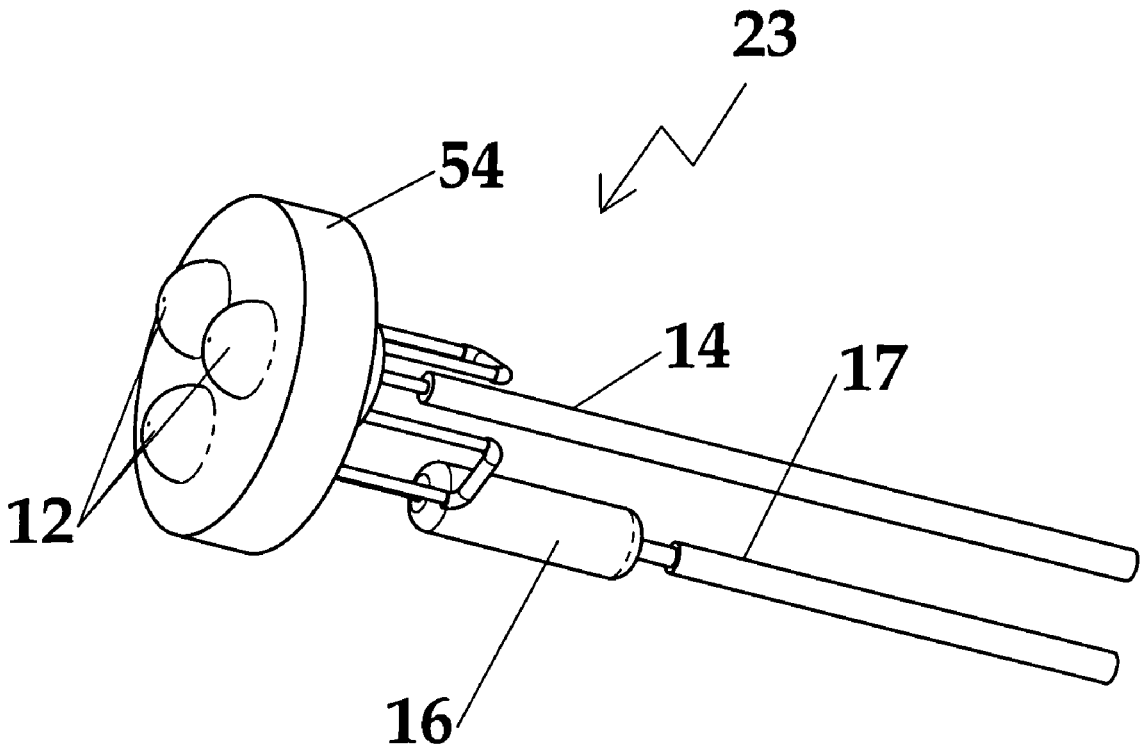
FIG. 5*a* is a pictorial side view of a miniature lighting assembly with several LEDs.
Figure 5B:
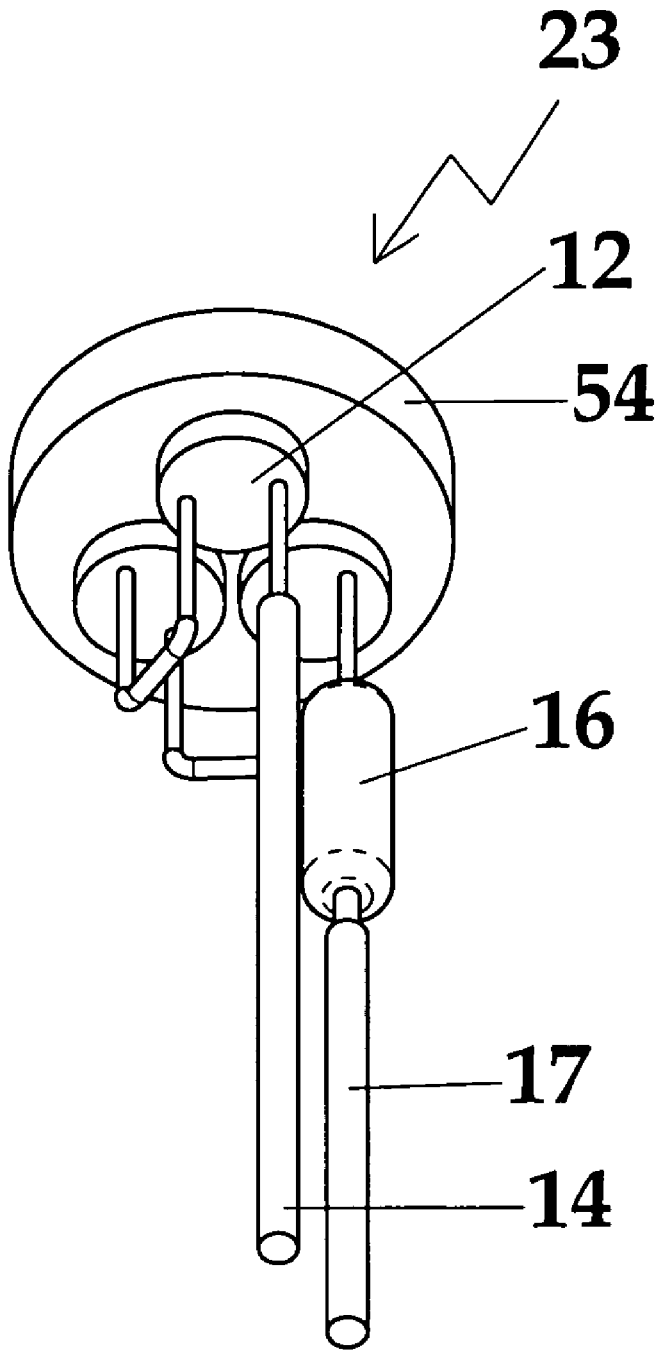
FIG. 5*b* is a pictorial bottom view of the miniature lighting assembly of FIG. 5*a* with several LEDs.
Figure 6A:
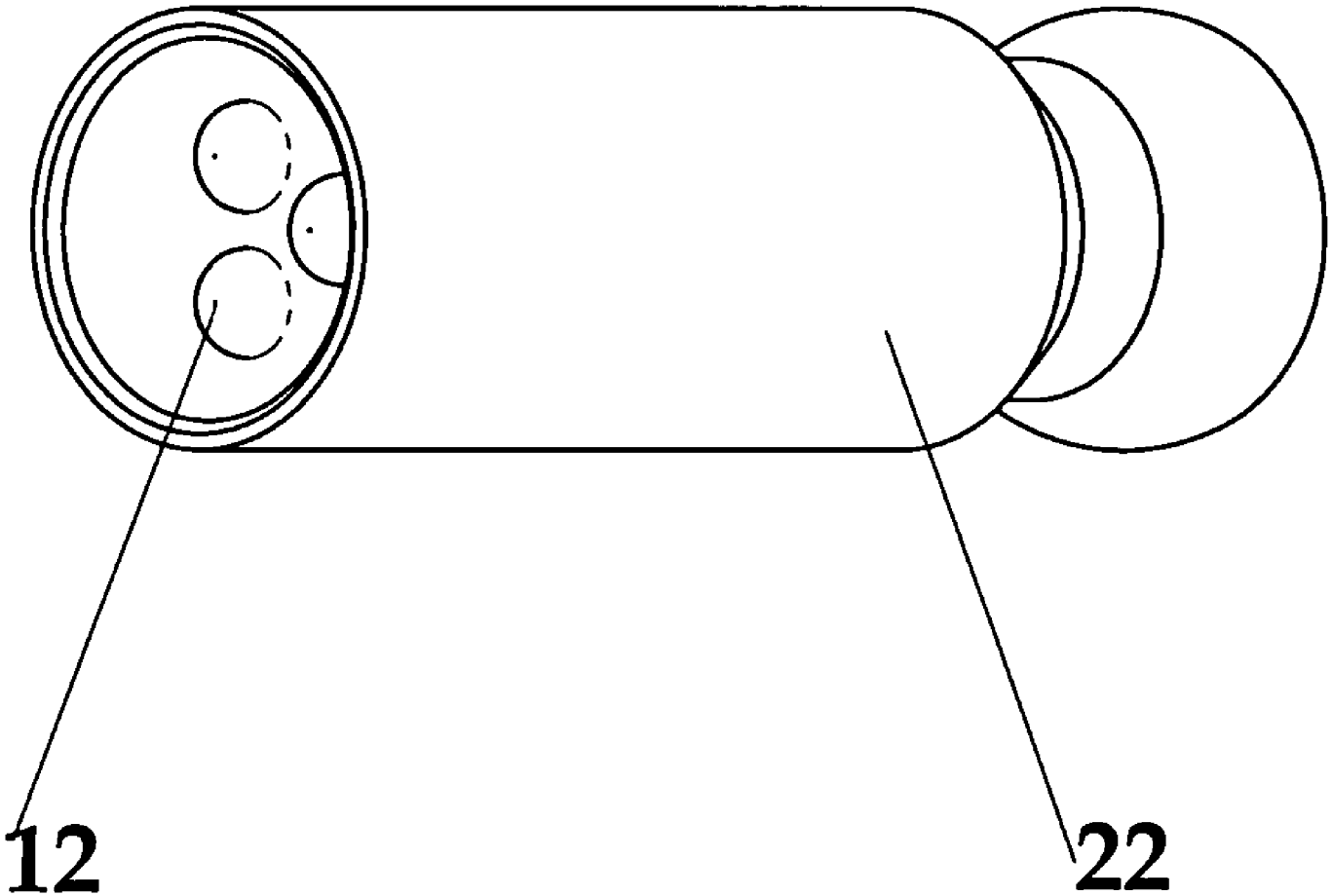
FIGS. 6*a,b* are pictorial views of various housings containing a miniature lighting assembly with several LEDs.
Figure 6B:
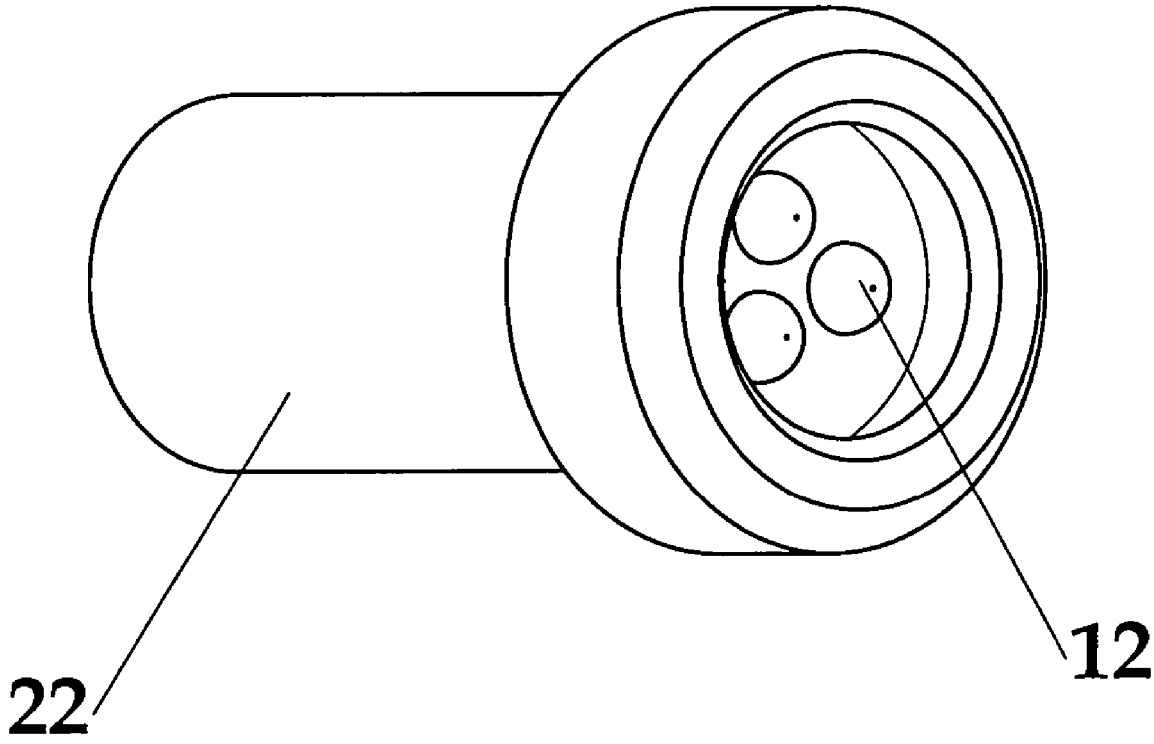

Referring to FIGS. 5*a–b*, another embodiment of the miniature light assembly 10 includes several LEDs 12 grouped together and electrically connected to a negative lead or prong 14, a resistor 16, and a positive lead or prong 17 as previously described in the first embodiment. The LEDs 12 are held in place by a disk mount 54. Referring also to FIGS. 6*a–b*, the electrical component assembly 23 is then pressed into the housing 22, which may have a variety of shapes. Once the assembly 23 is pressed into the housing 22, epoxy is poured into the housing 22 at the bottom portion of the housing 22 in order to permanently seal and unitize the circuitry and LEDs 12 with the housing 22.

The lighting bar system of the present invention, which preferably incorporates a plurality of miniature light assemblies such as described above, is useful in emergency lighting in houses or any other buildings, and may be permanently or temporarily installed with ease. Depending on the size of the room, one or more lighting bars may be permanently mounted into the walls, preferably approximately 12" from the ceiling, or into the ceiling itself. Such installations generate a brighter light inside the room, since the ceilings reflect the bright white light of the LED 12. A small room may only require one lighting bar, whereas an average 10'×10' room may require two or three lighting bars. Corridors may require one lighting bar having miniature light assemblies 10 positioned within the bar every six to eight feet. Although the illumination provided by the miniature light assemblies 10 is probably not bright enough to permit reading in such rooms, the brightness is certainly sufficient to see all objects inside the room, find the doors, windows, beds or other features very easily. When not in use, the miniature light assemblies 10, due to the very small size of their face and being flush with the wall, are hardly noticeable and will not detract from any decor.

Figure 7A:
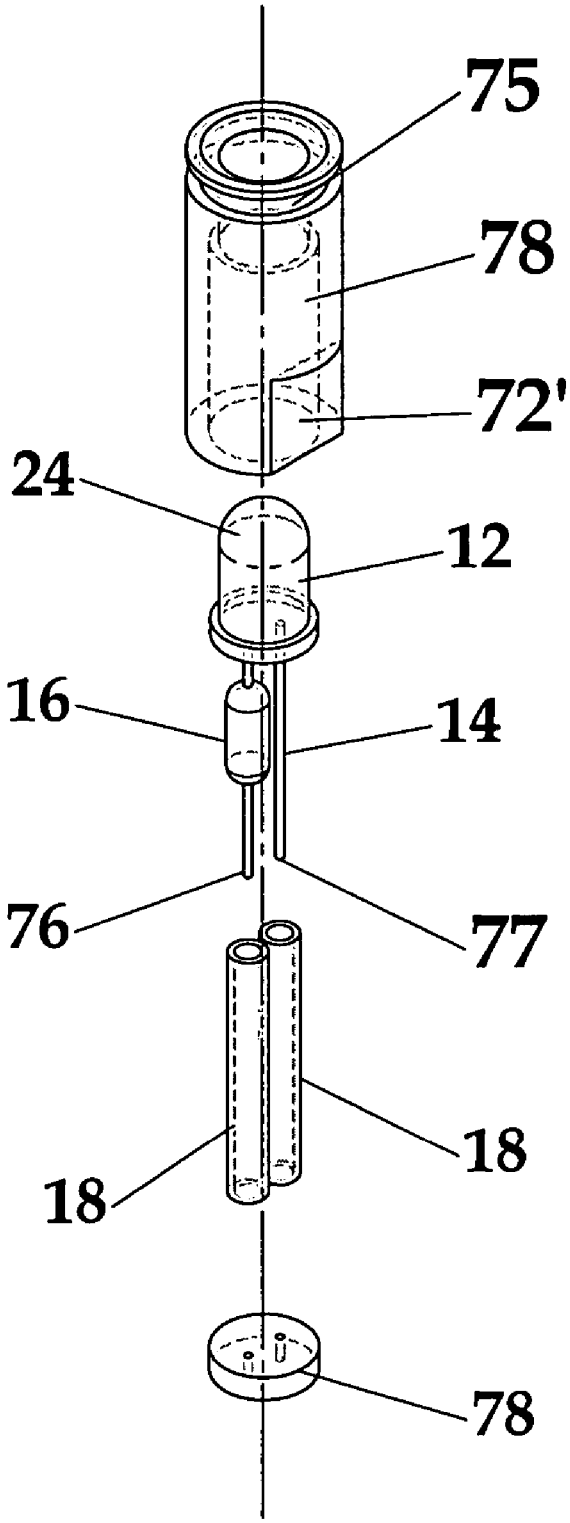
FIG. 7A is an exploded view of a miniature lighting assembly having two rigid electrical leads.

FIG. 7*a* presents an exploded view of a miniature light assembly having a light source within a housing 78 and end cap 84. Through the end cap 84 protrude a positive lead or prong 76 and negative lead or prong 77 for supplying power to the light source, which is preferably an LED.

Figure 7B:
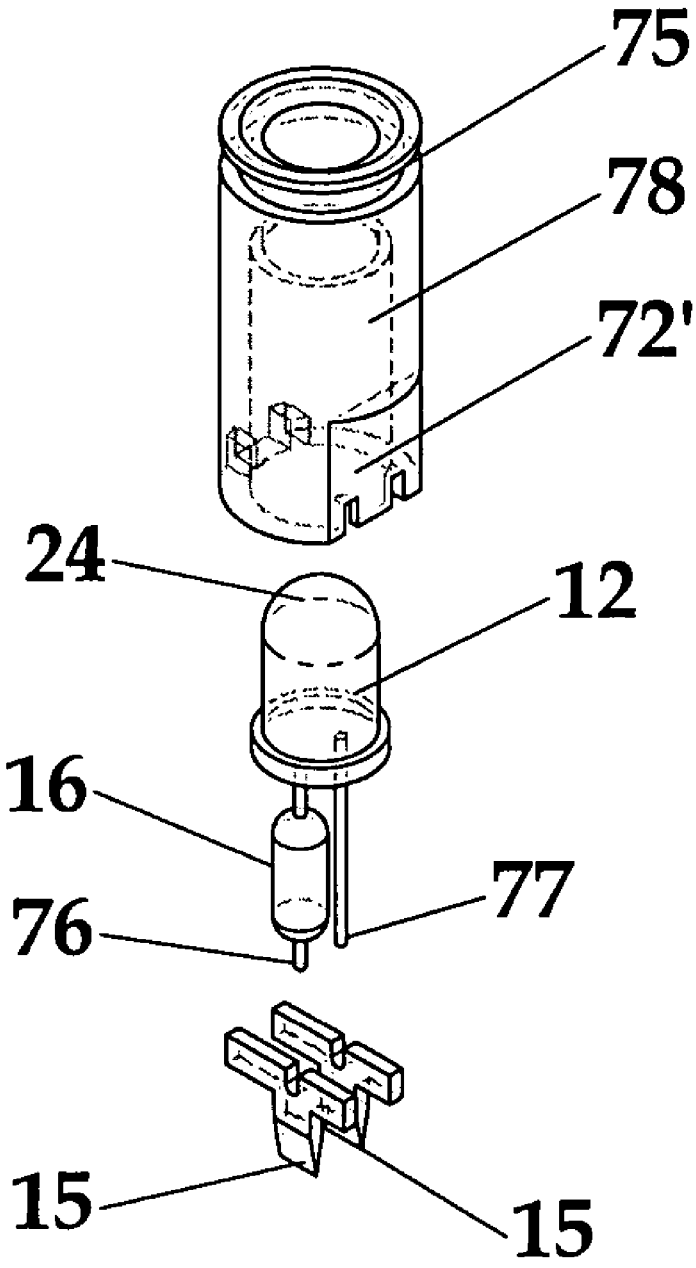
FIG. 7B is an exploded view of a miniature lighting assembly configured with electrically conducting blade fixtures connected to the ends of the electrical leads of the assembly.

FIG. 7*b* presents a preferred alternative embodiment of the miniature light assembly. As shown, at the end of each of the prongs 76,77 are connected conductive blade fixtures 15. The blades are in electrical contact with the prongs, and oriented so as to allow stabbing into the electrical supply line along the long axis of the supply line. This more effectively creates a connection between the miniature light and power supply. The conductive blade fixtures' orientation can be assisted by means of, for example, alignment notches in the light housing 78.

Figure 8:
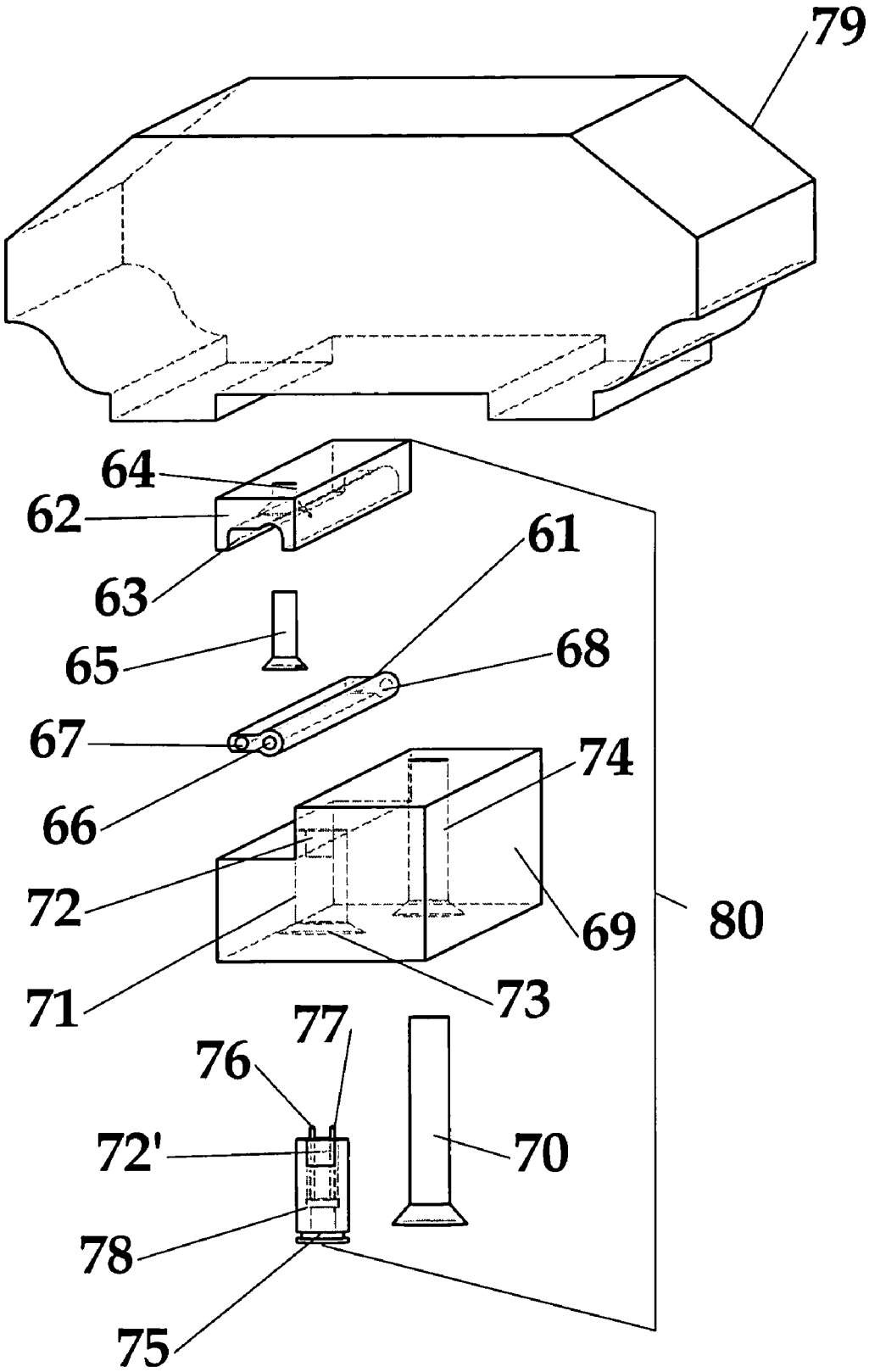
FIG. 8 is an exploded view of a lighting bar system in accordance with the present invention, illustrated in a railing embodiment.
Figure 9:
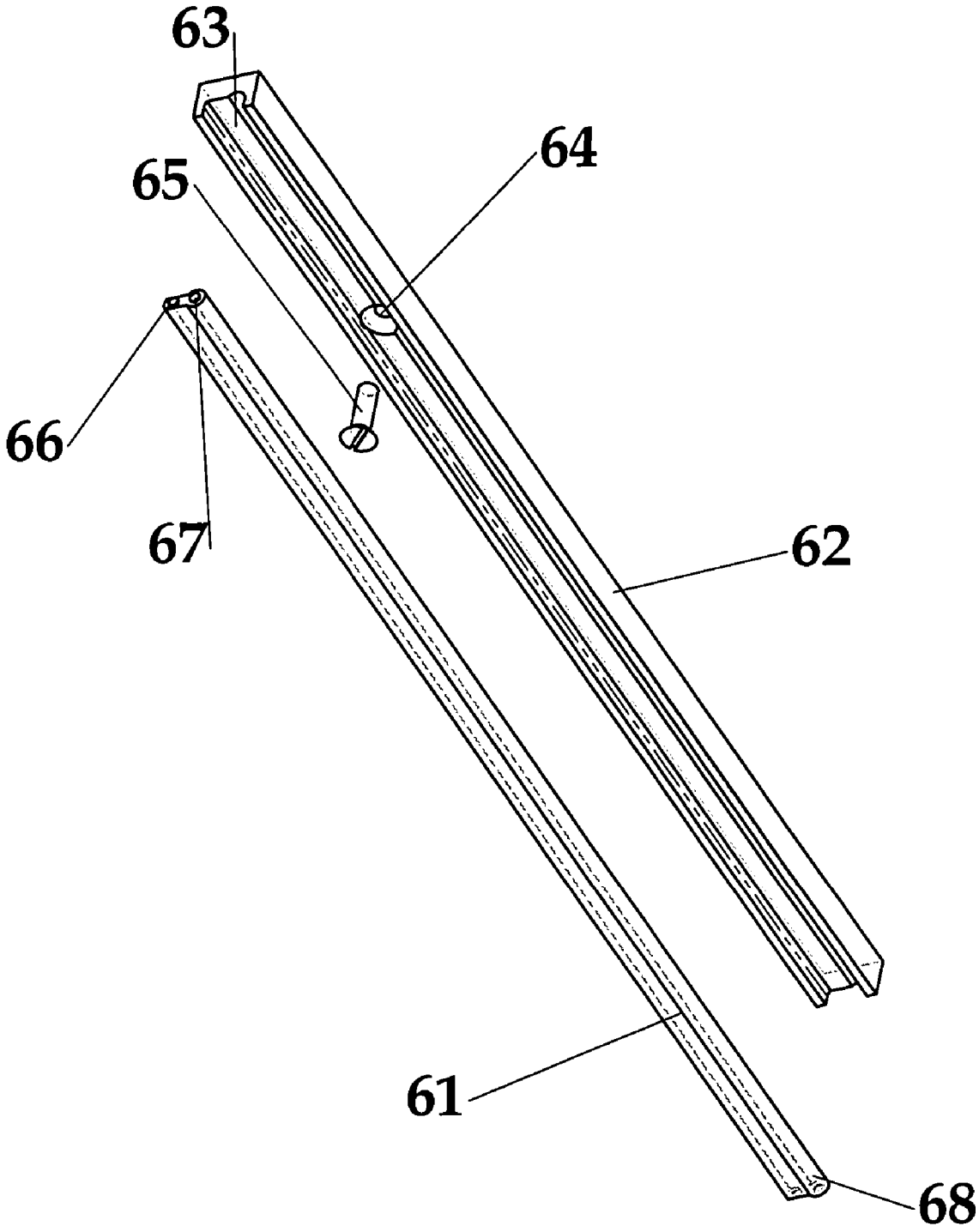
FIG. 9 is a pictorial exploded view of a supply line housing component and supply line of a two-component lighting bar configuration in accordance with an embodiment of the present invention.
Figure 10:
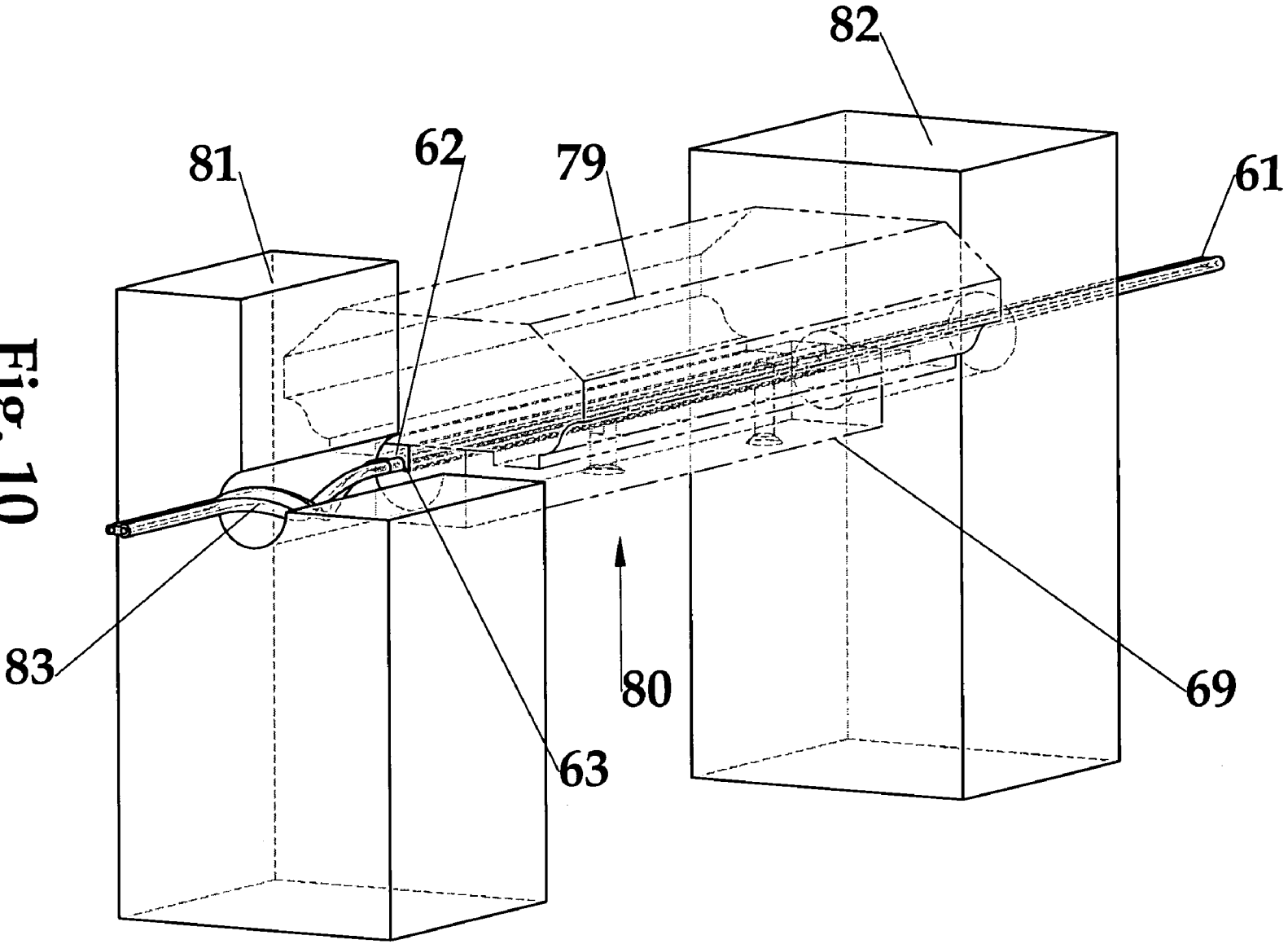
FIG. 10 is a pictorial view of a lighting bar system of the present invention in a railing environment.

Before describing in detail FIGS. 8-16 of the drawing, reference is made to the embodiment of a lighting bar 80 depicted in FIG. 10, which may be utilized in railings such as found, for example, in deck railing. Each miniature light assembly is connected to a single supply line through their positive and negative leads or prongs. For standard or emergency use, the supply line may be powered by one or more standard 12V batteries or converted wall power supply. The batteries may then be charged either by a solar charging unit thus completely avoiding any electric power supply or by a suitable, commercially available trickle charger, which keeps the batteries fully charged during the time when electricity is available, for use in electric emergencies. Since the power requirements of LEDs are low (approximately 20 milliamps each), very little charging by solar energy is required. Consequently, lighting assemblies can provide illumination over a long period of time on a standard 12V battery without any recharging. For example, an installation of 20 LEDs, operated only at night without battery recharge, took four days to drain a standard battery and thus would provide many more hours of use than any existing emergency system, which typically lasts for only a few hours. The lighting bar system may be used to illuminate any size deck railing to provide a measure of safety and a beautiful accent to the railing itself. Lighting bars may be mounted under the top rail with the light sources shining downward, providing light on the rail without loss of night vision. The installations of the miniature light assemblies in rails are exceptionally easy and accomplished using simple tools such as a drill, screwdriver, saw and screws, and/or with glues and epoxies.

Lighting bars 80 may be used to provide illumination for walkways using brick, natural, or concrete paving stones of any shape. In all stone applications, a masonry drill is used to form a channel for the light bar(s) and to drill one or more holes through the stone for securing the light bar. It is preferred for safety purposes that the light bar lies recessed below the surface of the stone, thus protected from any traffic. As paving is laid, light bars can be inserted into pre-cut stones and held in place by fasteners or sealants. An end of a lighting bar may be sealed to protect the supply line within, and the supply line itself is then connected to a power source, which can either be activated by a switch, photo-eye or timer. In such applications, any light pattern design may be possible. The light bar can be manufactured from a variety of materials in straight or curved sections and/or in articulating segments to adapt to any setting.

Lighting bars 80 also have application in any marine environment. A small number of the miniature light assemblies 10 installed in a cockpit of a boat can illuminate the space or the steps down in such a way as to avoid the loss of night vision. In any cabin, one or more of the miniature light assemblies 10 can provide enough illumination to comfortably use the space such as near bunks, over galley equipment, or as spot or emergency lights in the salon. This is especially useful when attached to a rigging, where such miniature light assemblies 10 can illuminate upwards towards the sails, or downwards towards the blocks and other equipment. The exceptionally small, compact size of the light bars makes installation feasible even in applications that were not previously accommodated with standard lights.

Another application of the light bars is in illumination within and around vehicles. The light bars may be mounted into or onto the sides of truck loading beds, or the "roll bars" or compartments of vehicles. The advantages of the light bars include manufacture and adjustment of size and shape to fit an application, durability, and easy installation.

Various systems and components of the present invention are now described with reference to FIGS. 8 through 16.

An exploded view of a cross-section of one embodiment of the lighting bar 80 is shown in FIG. 8 (illustrating only one miniature light assembly for the purpose of clarity.) With reference to FIGS. 8 and 9, a supply line housing 62 is attachable to any desired surface, such as the underside of a wooden handrail 79 for deck railings, by means of suitable fasteners 65, inserted into through-holes 64 of a suitable shape and diameter, or alternatively through adhesives. In this embodiment, the supply line housing 62 has a special recess 63 on a surface that will be positioned flush with an opposed surface of mounting bar 69, thereby defining a channel within which an electrical supply line 61 will be secured. The electrical supply line 61 may be of the type commercially available and configured with a positive wire 66 and a negative wire 67 covered by a plastic housing 68 that is asymmetrically shaped such that the supply line can be fit into the special recess 63 of the supply line housing 62 with only one orientation. That is, the electrical supply line 61 is aligned and oriented according to the shape of recess 63 to ensure the proper positioning of the positive wire 66 and a negative wire 67 within the channel formed between the mounting bar 69 and supply line housing 62.

The mounting bar 69 includes one or more specially shaped recesses 71 capable of receiving the miniature LED light assembly housing(s) 78 in one orientation only, thus ensuring the proper orientation of the positive lead 76 and negative lead 77 of the light source with relative to the positive wire 66 and a negative wire 67 of the supply line 61. The recesses 71 may have flats 72 to perfectly accept a corresponding flat 72' on the LED light housing 78. A recess or relief 73 allows a small flat screwdriver or similar tool to be used to pry out the LED light housing in case replacement is required. Other means for assuring the proper orientation of the electrical supply line 61 may be employed in addition to or as an alternative to the asymmetrically shaped recesses 71, such as color-coding portions of the supply line recess and/or identification by traditional symbols "+" and "−".

Suitable, commercially available fasteners 70 such as screws, nails or bolts can be inserted into through holes 74 to firmly affix the mounting bar 69 to the supply line housing 62 and to the desired mounting surface, such as the underside of handrail 79. Proper positioning of the through holes 74 with respect to the supply line housing 62 assures no fastener 70 contact or interference with supply line 61.

The preferably opaque LED light housings 78 are shaped in such a way as to be fit and aligned inside the specially shaped recesses 71. The housings may also contain flanges or grooves 75 that can determine the exact depth they can be inserted into the recess 71 in order to assure penetration by the positive lead 76 and negative lead 77 of the light source through the plastic housing 68 and into electrical contact with the corresponding positive wire 66 and a negative wire 67 of the supply line 61. The positive lead 76 and negative lead 77 of the light source consist of rigid prongs having beveled or sharpened tips designed to be of a shape and strong enough to puncture the outer plastic cable covering 68 of the electrical supply cable 61.

With reference to the perspective view provided in FIG. 10, a lighting bar assembly including the near seamlessly mated mounting bar 69 and supply line housing 62 has been secured to the underside of a railing top cap 79. The electrical supply line 61 passes through intermediate stanchions 81 or corner posts 82 and can be twisted at point 83 when passing through those posts, however the recess 63 of the supply line housing 62 facilitates proper realignment as the supply line 61 is passed to the next light bar segment or to a power supply.

FIGS. 11*a–d* illustrate alternative configurations of the lighting bar assembly. Note that the relative position of the electrical supply housing with respect to the mounting bar to which it is mated may be varied, and that the cover bar may have a variety of shapes to match the particular structure to which it is secured. Other aesthetically pleasing and functional variations in the cover bar are deemed to be within the scope of the present invention. It will be obvious to those skilled in the art that multiple lighting bars could be combined to expand the functionality and range of use of the present invention, such as noted above in illuminating all sorts of walkways, landscapes and motor and/or marine vehicle applications.

Figure 11C:
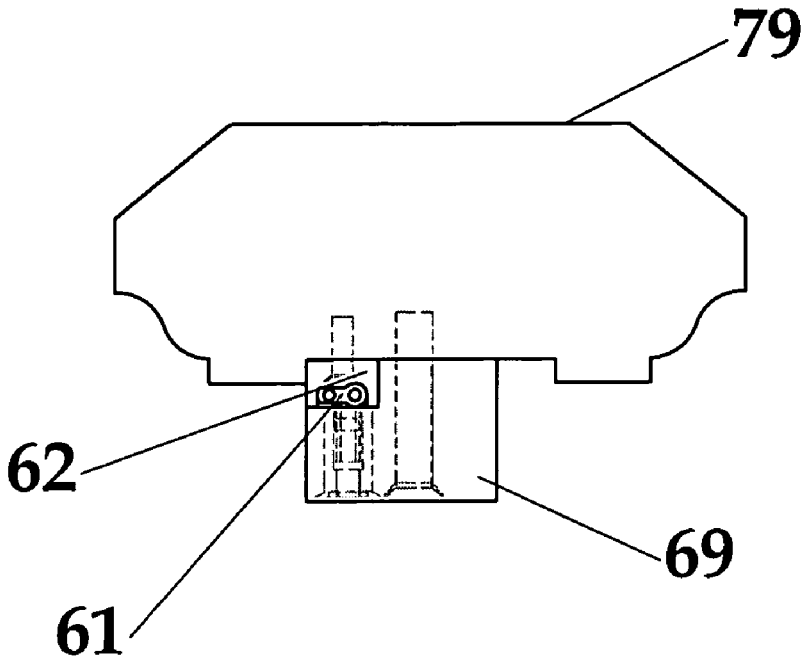
FIGS. 11*a–d* are pictorial views depicting alternative single and two-component configurations of the line supply housing and cover bar.
Figure 11B:
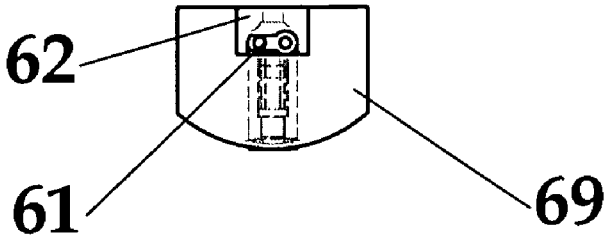
Figure 11A:
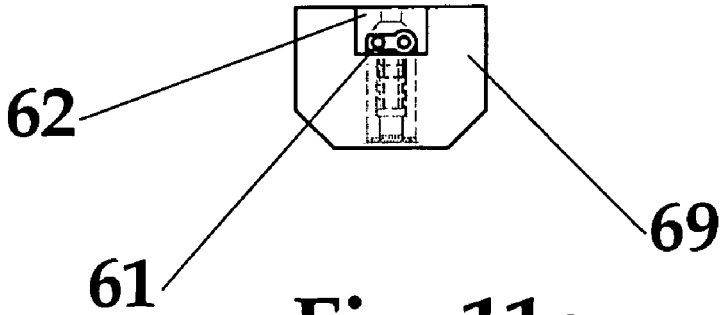
Figure 11D:
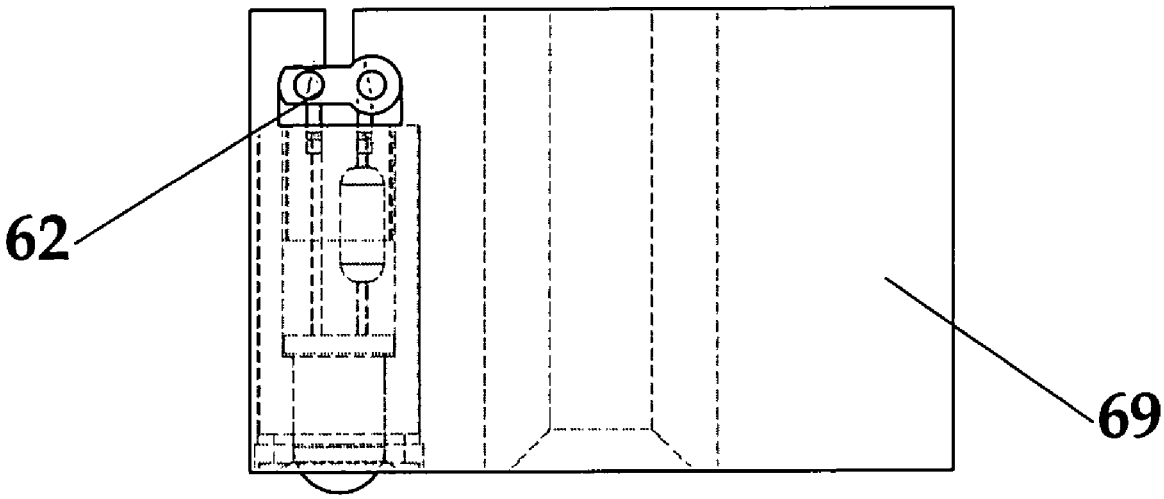

FIG. 11*d* illustrates a significant variation of the lighting bar design, in which the electrical supply line 61 is positioned within a groove 63 of the mounting bar 69, eliminating the need for a separate supply line housing component. The internal groove preferably has an inverted "T" shape with an opening to an exterior surface of the mounting bar wide enough to facilitate the supply line placement but narrower than the internal portion of the groove so as to minimize the possibility of undesired displacement of the supply line. This groove may also be asymmetrically shaped or have the other features for assuring proper polarity described above.

Figure 12A:
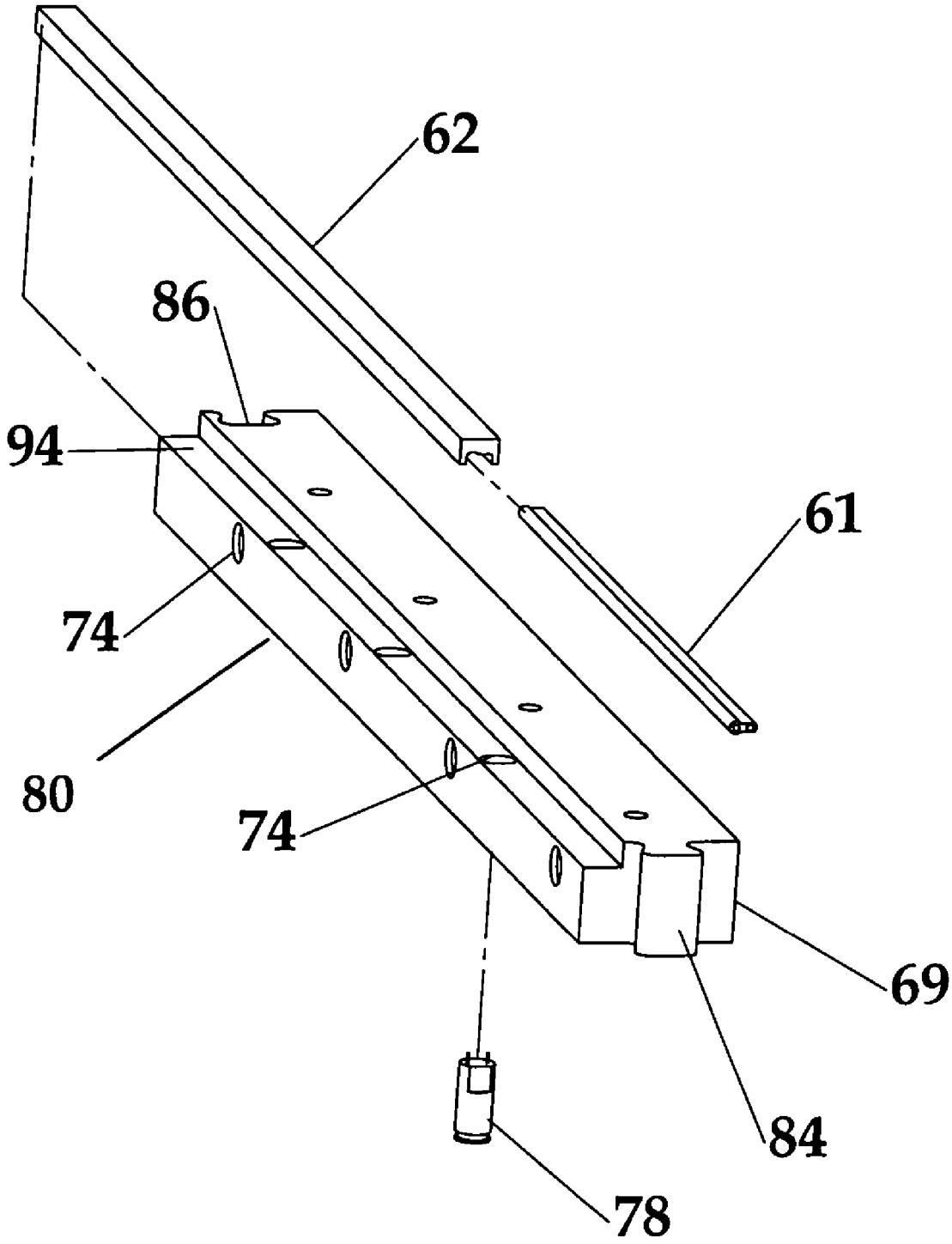
FIGS. 12*a–c* are exploded and perspective views of a lighting bar in accordance with the principles of the present invention.
Figure 12B:
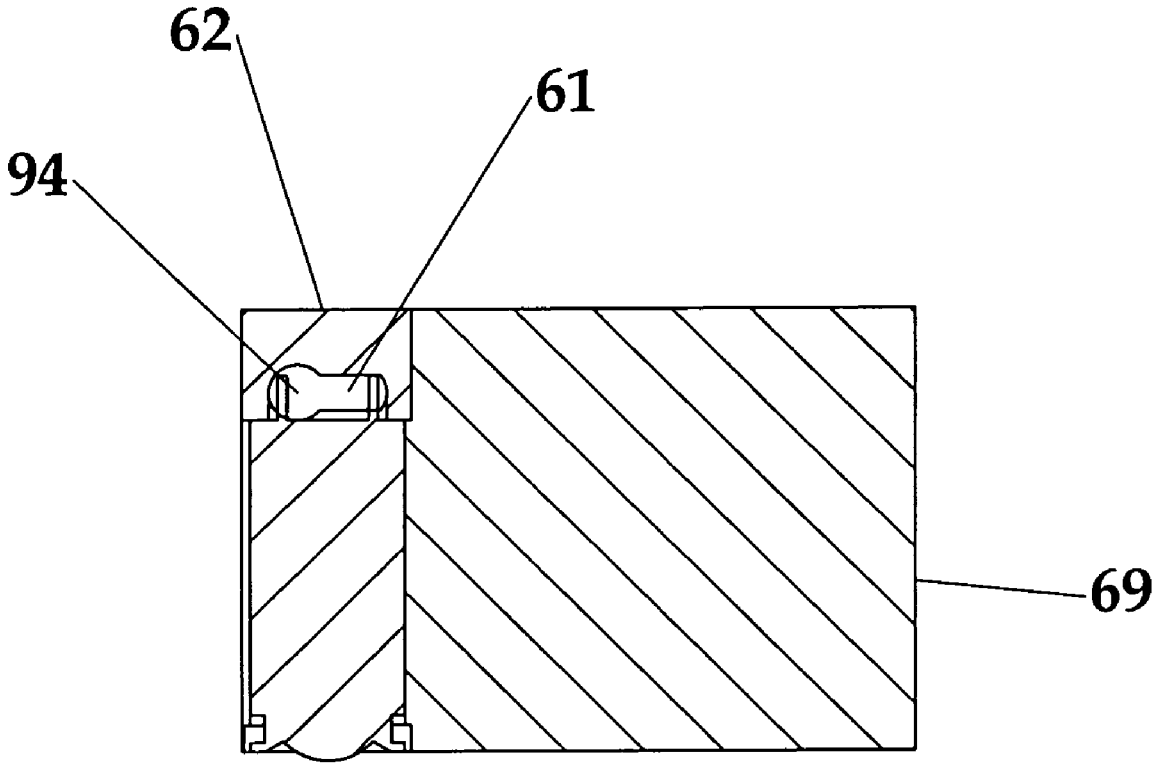
Figure 12C:
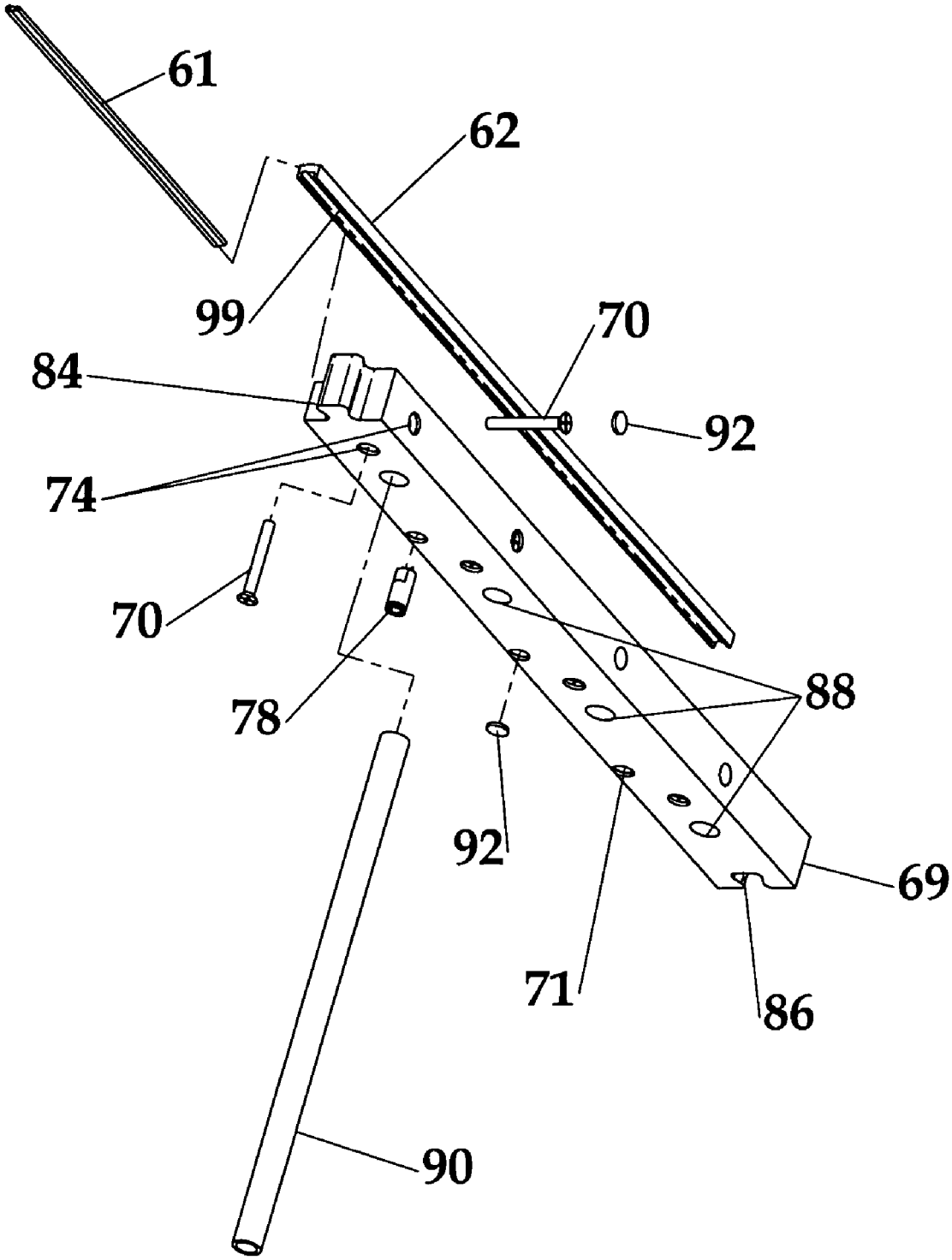

FIGS. 12*a–c* illustrate several additional embodiments of lighting bar 80, wherein the mounting bar 69 is preferably made from nylon or polymer suitable for injection molding to enhance color selectivity and mass production. The lighting bar 80 will typically be a basic color such as white, black or gray depending on intended use with wood, PVC or other material used in the deck railings. One end of the mounting bar 69 has a male dovetail connector 84 and the opposing end a female dovetail 86. This arrangement allows the use of standardized bar lengths and essentially eliminates any waste, since off-cuts from one lighting bar section can be used to start another application section.

With reference to FIG. 12*c*, at regular intervals (e.g., 100 mm), perhaps in compliance with building codes, the mounting bar 69 has on one surface a plurality of recesses 88 shaped to receive an elongate, rigid member such as, for example, a vertical tube or bar used as a spindle or baluster 90. Each of the baluster-receiving recesses 88 is preferably offset from the center of the mounting bar 69 and does not traverse the entire height of the mounting bar, so as to capture securely the end of the baluster 90.

Also offset from the centerline of the mounting bar are through-holes 74 suitable to either accept fasteners 70 such as, for example, commercially available attachment screws, and/or recesses 71 in which may be mounted miniature light assemblies 78 such as described above. As reflected in FIG. 12*c*, through-holes 74 may be arranged horizontally and/or vertically depending on the desired mounting configuration to secured the lighting bar via fasteners 70 to any desired surface orientation. A suitably dimensioned disc or cap 92 can be used to plug any through-holes 74 or miniature light recess 71 not used for fastening or lighting, thereby providing a closed surface when complete. Each lighting recess 71 terminates in the channel 94 formed between the mounting bar 69 and electrical supply line housing 62 positioned on the top surface of the mounting bar 69. As described above, the channel 94 is used to securely orient and conceal the electrical supply line 61 so that positive and negative leads of an LED can penetrate the supply line with the proper polarity.

Figure 13A:
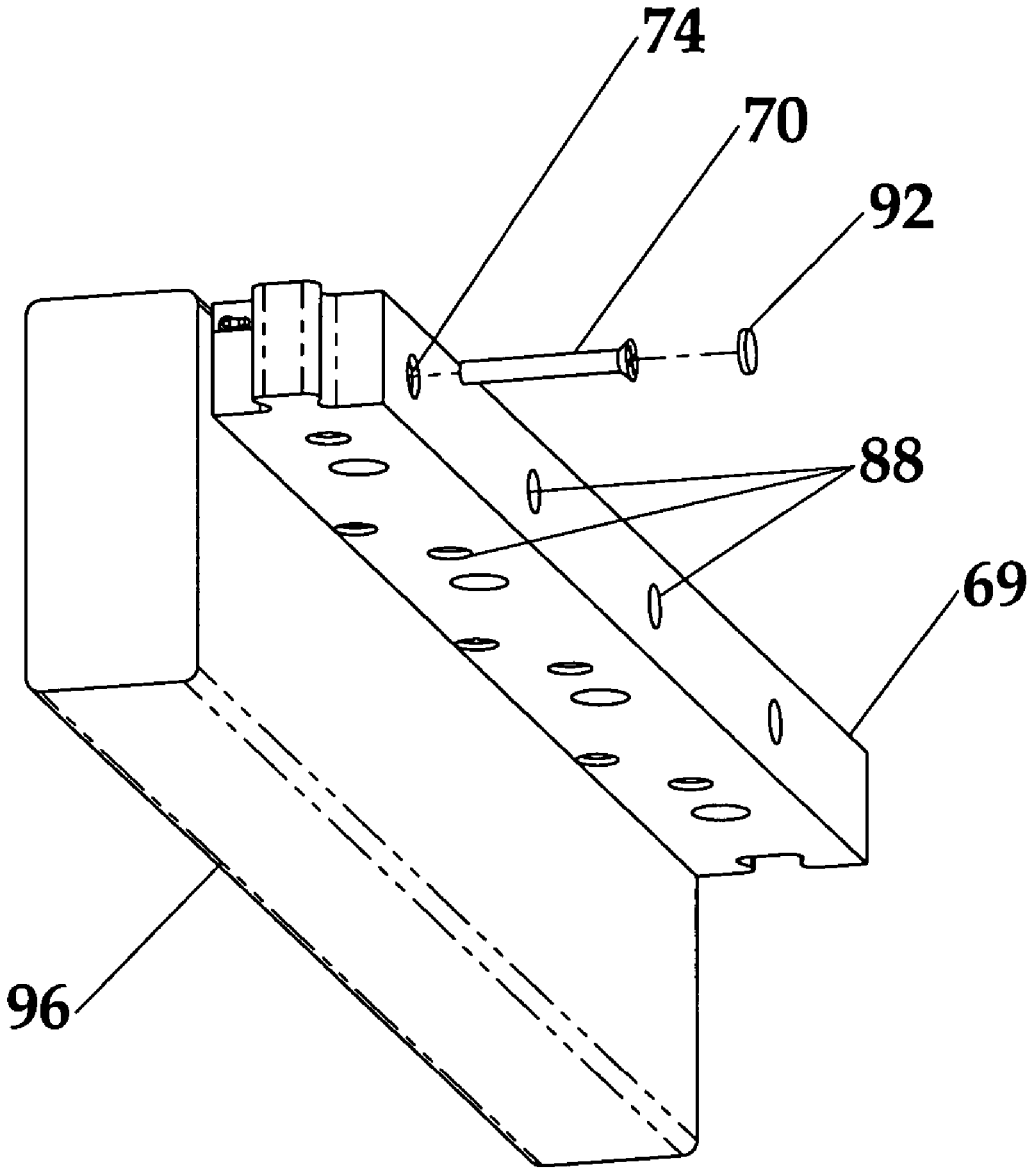
FIGS. 13*a–d* are perspective views illustrating a variety of attachment scenarios for the lighting bar to railing components.
Figure 13B:
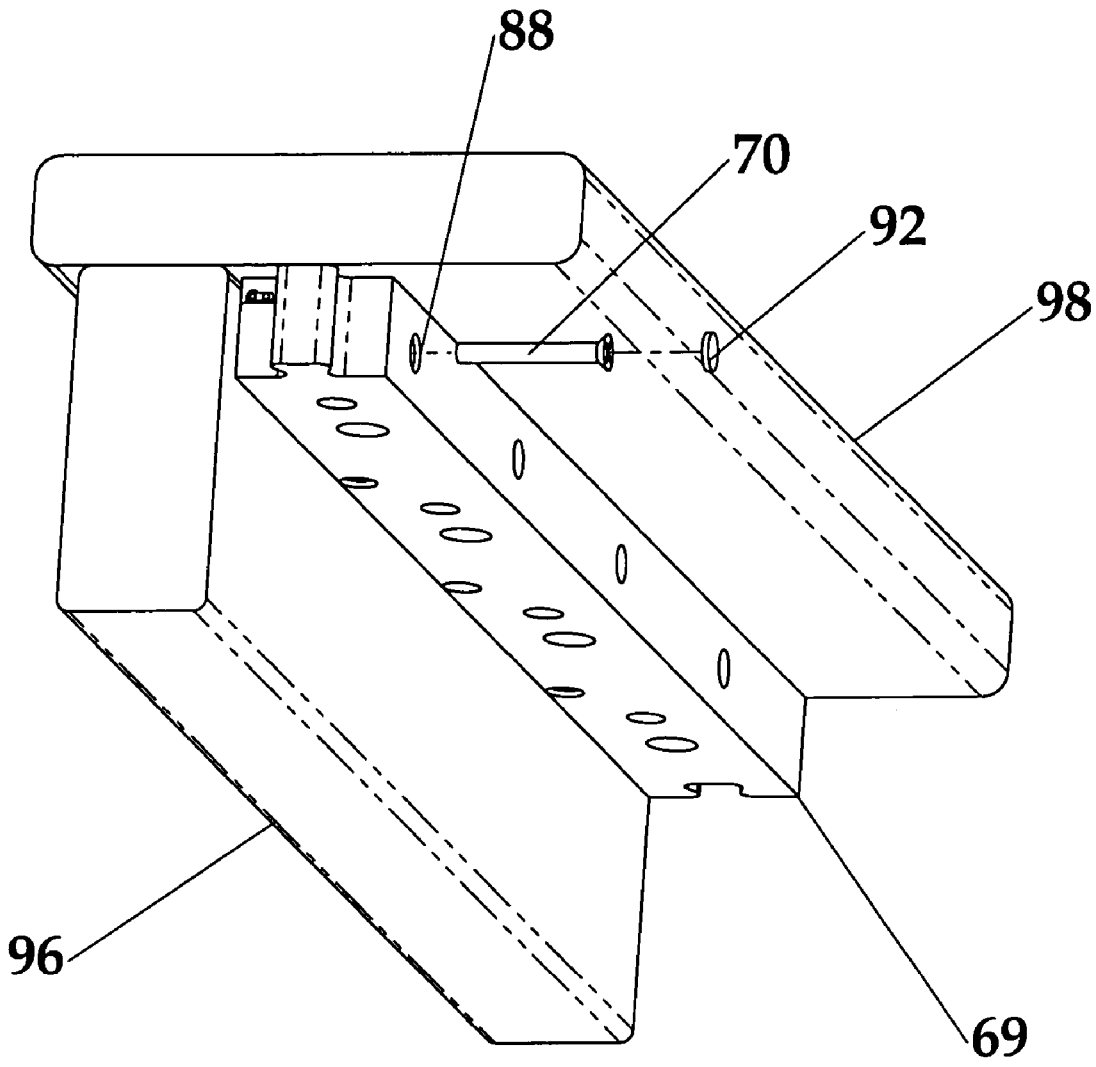
Figure 13C:
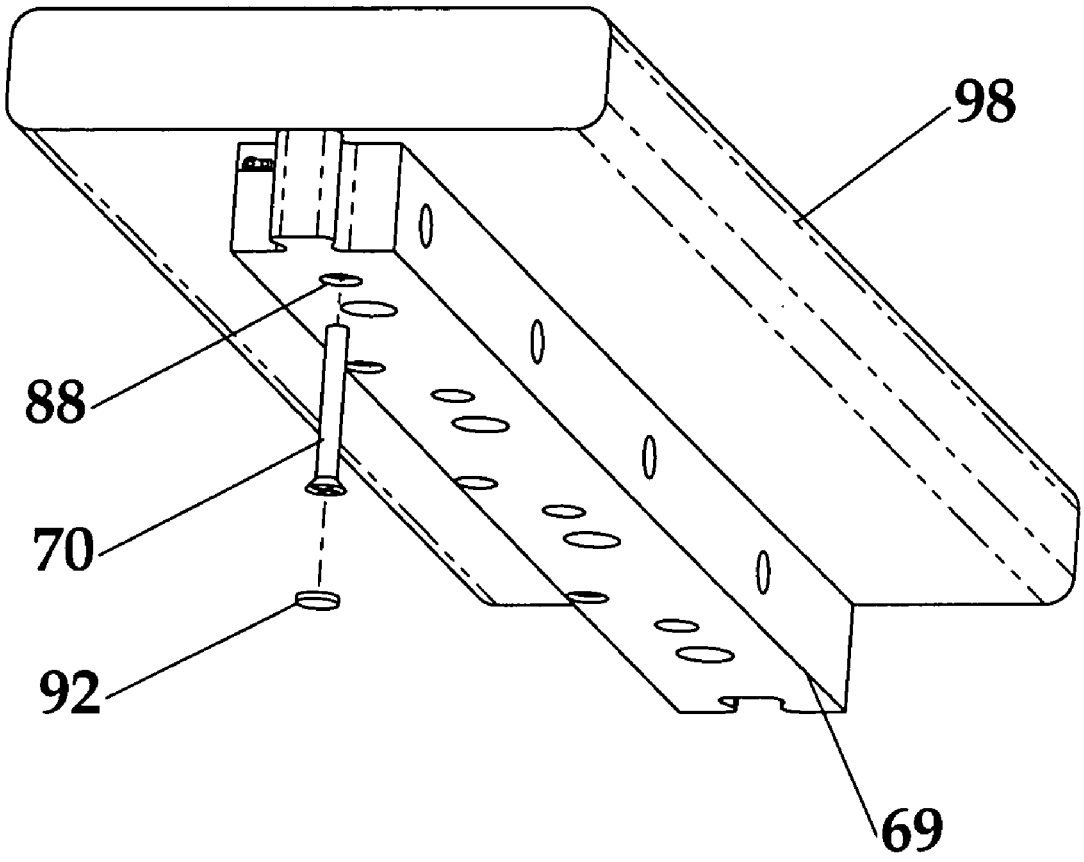
Figure 13D:
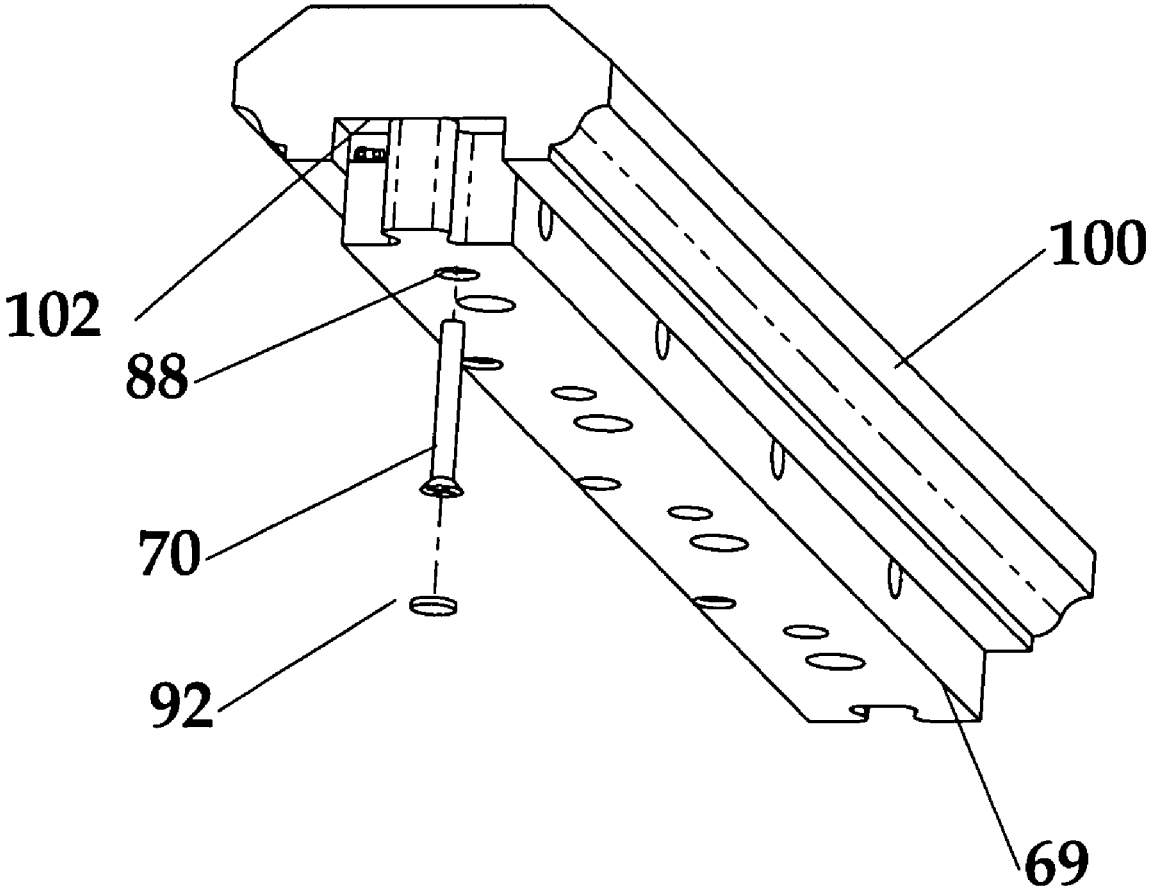

FIGS. 13*a–d* illustrate a variety of potential lighting bar attachment configurations to support surfaces, which are shown for example purposes to be portions of a railing, but which could be virtually any surface of the application types noted above. The mounting bar 69 can be attached, for example, to either a horizontal wooden or PVC top support 96 (FIGS. 13*a–b*) and/or to a top cover board 98 (FIGS. 13*b–c*.) Once the fasteners 70 have been tightened, the caps 92 can be inserted to cover the through-holes 74 to hide the fasteners. FIG. 13*d* illustrates the use of the lighting bar with a shaped wooded or PVC top rail 100. Commercially available top rails 100 typically have a groove 102 on their underside within which the mounting bar 69 may be mounted.

Figure 14:
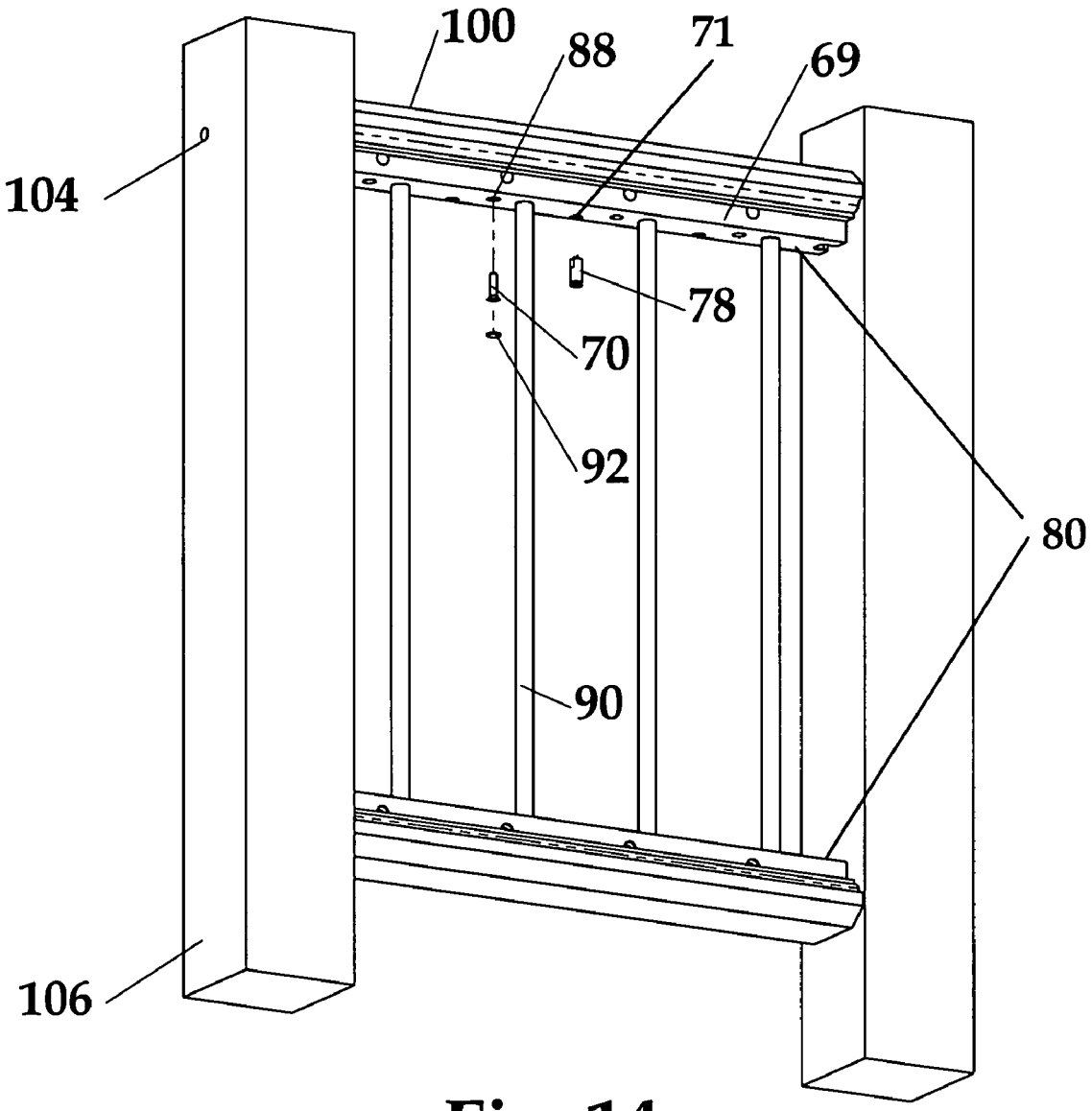
FIG. 14 is a perspective view of a complete assembly utilizing lighting bars in both the top and bottom of a rail section.

FIG. 14 presents a perspective view of a railing section that employs lighting bars 80 in the top and bottom rails to securely capture the balusters 90 between the mounting bars. Vertical and/or horizontal through-holes 88 and lighting recesses 71 may be used for miniature light assemblies 78 and fasteners 70, or may be plugged by caps 92 when not used to create a smooth, maintenance free surface. A bore 104 at a suitable location of the railing post 106 provides a means to electrically connect to or pass the electrical supply line from one railing section to the next. Although the mounting bars 69 are depicted as rectangular and the balusters 90 cylindrical, it will be appreciated that either may be formed in a variety of shapes (e.g., hollow or solid squares, ovals etc.) and materials to meet the design requirement soothe particular application.

Figure 15:
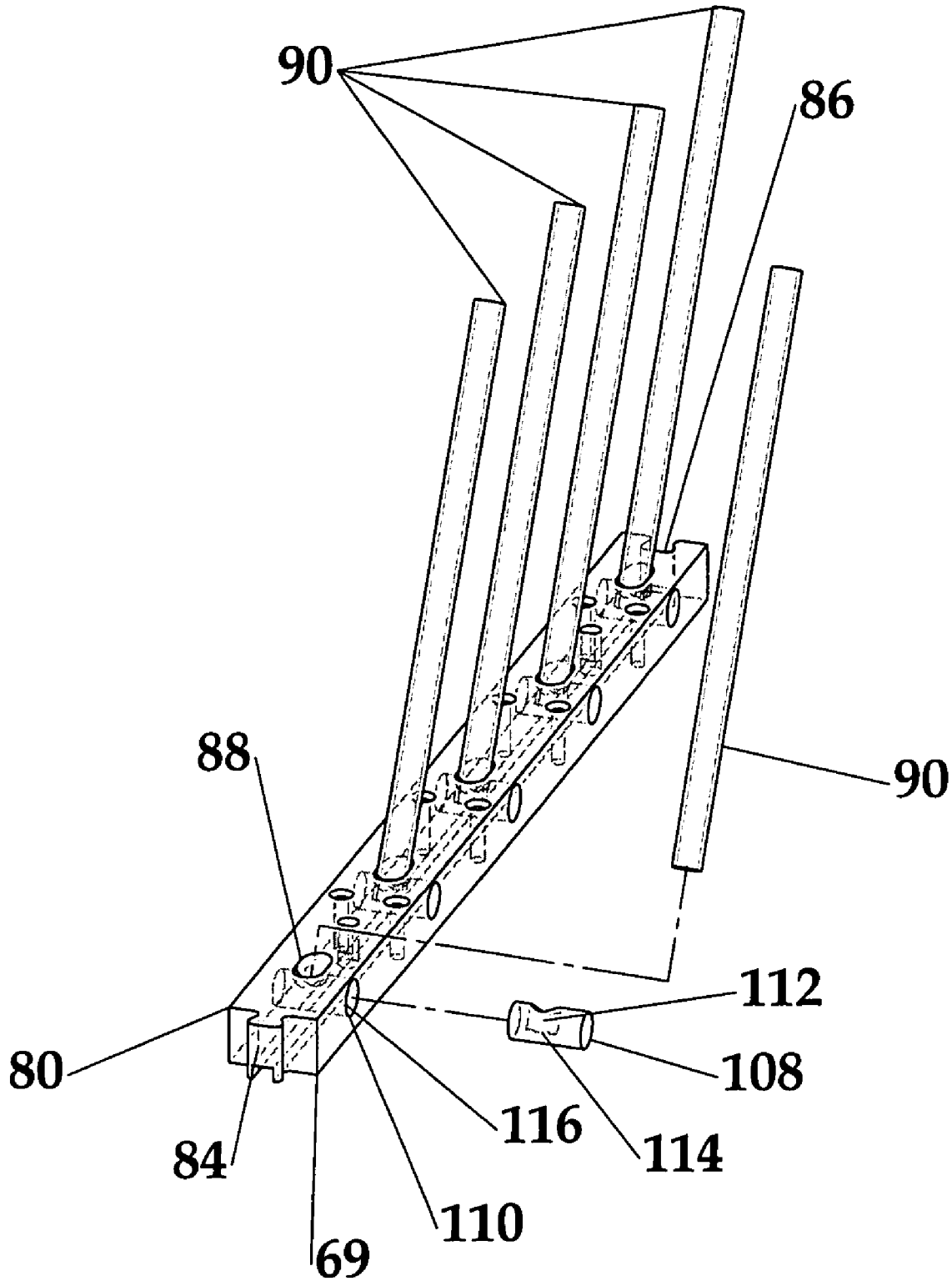
FIG. 15 is an exploded perspective view of a typical stair mounting bar system, embodying the principles of the present invention.

FIG. 15 presents an exploded view of a preferred embodiment of a modular lighting bar 80 in accordance with the present invention. The mounting bar 69 enables fitting of balusters 90 in a railing of a staircase through use of a plurality of rotating plugs 108, which are formed with smooth surfaces to allow rotation in plug recesses 110. The rotating plugs 108 are preferably, but not necessarily, composed of the same material (e.g., nylon, plastic, metal, wood) as the mounting bar 69 for aesthetic reasons. As described above, the ends of the mounting bar may allow interlocking with other mounting bars, such as, for example, through male dovetails 84 and female dovetails 86. This arrangement allows standardizing the length of lighting bar and essentially eliminates any waste, since off-cuts from one section can be used to start the next section. The plug recesses 110 appear in a surface of the mounting bar 69 at regular intervals and/or in compliance with building codes, and preferably have circular cross-sections dimensions sufficient to firmly hold the rotating plugs 108. Each rotating plug 108 in turn has a feature, such as a baluster recess 112 of a suitable shape and dimension to accept the end of a baluster 90. Each baluster recess 112 terminates within the rotating plug 108 at a surface 114 to prevent the baluster 90 from interfering with the free movement of the rotating plug 108 about its longitudinal axis 116.

Each plug recess 110 extends within the mounting bar 69 so as to connect with a corresponding recess 88, which in this embodiment are preferably oval-shaped to accommodate insertion of the end of a baluster 90 and allow pivoting of the baluster about the axis 116 of the rotating plug 108. Once the end of the baluster or spindle has been inserted through the mounting bar recess 88 into the baluster recess 112 of the rotating plug 108, the baluster can pivot freely in the direction of the length of the mounting bar 69 in order to accommodate any conventional stair case angle. The baluster 90 is held firmly by the rotating plug 108, which is in turn prevented from slipping out of the plug recess 110 without requiring use of fasteners of any kind, making installations on standard stair cases quite easy.

Figure 16:
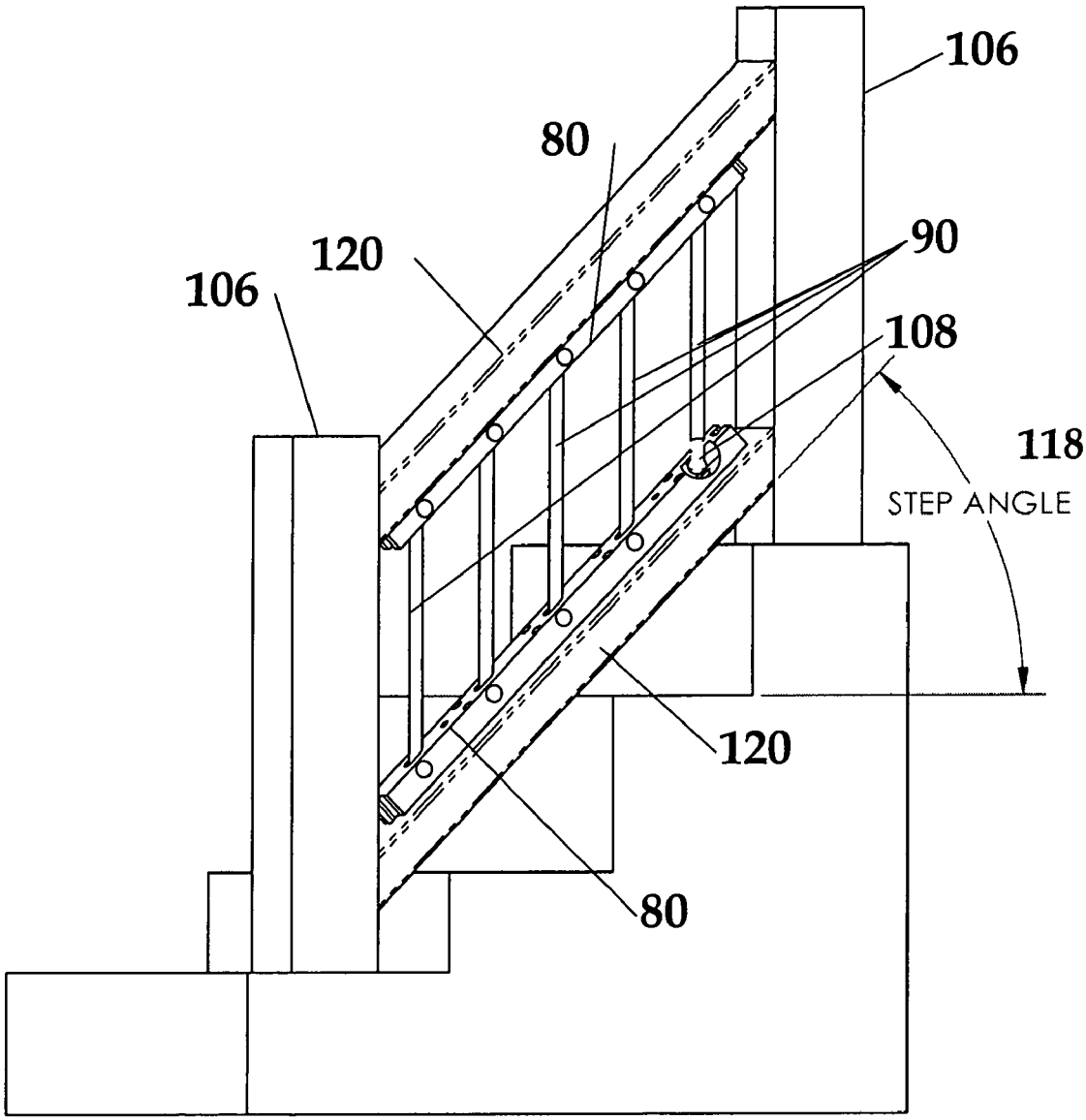
FIG. 16 is a perspective view of a complete assembly showing top and bottom stair mounting bars with balusters or spindles and lighting, and a preferred way of attachment to posts.

FIG. 16 illustrates an installed railing section employing lighting bars 80 in both the upper and lower rails to mount a plurality of balusters 90 whose ends are secured within rotating plugs 108. The assembly and alignment of all components can be accomplished easily prior to mounting between railing posts 106, and then the complete assembly can be adjusted to the desired stair angle 118 and mounted to a commercially-available top and bottom support or cap 120.

Although the invention has been described with respect to various embodiments, it should be realized this invention is also capable of a wide variety of further and other embodiments within the spirit of the invention.

I claim:

1. A modular lighting bar, comprising:

a housing having a length, a width, and a supply recess along the length of the housing dimensioned to receive an electrical supply line having a positive lead and a negative lead; and a mounting bar having a top surface, a bottom surface, two side surfaces and two ends, and including a housing recess along the top surface dimensioned to receive the housing and to orient the electric supply line therebetween, at least one light recess on the bottom surface for receiving a miniature light assembly, the at least one light recess dimensioned and positioned such that a positive prong and negative prong of a light assembly disposed in the at least one light recess makes electrical contact with the corresponding positive and negative lead of the electric supply line, a male connector at one of the two ends, and a corresponding female connector at the other of the two ends.

2. The modular lighting bar of claim 1, further comprising means for fastening the mounting bar to a surface.

3. The modular lighting bar of claim 1, wherein the mounting bar further comprises at least one through hole extending through the mounting bar through which the modular lighting bar is fastenable to a surface.

4. The modular lighting bar of claim 1, wherein the male connector and the female connector comprise interlocking dovetail connectors.

5. The modular lighting bar of claim 1, wherein the mounting bar further comprises at least one member-receiving recess on the bottom surface dimensioned to receive an end of at least one member.

6. The modular lighting bar of claim 5, wherein the at least one member is a baluster.

7. The modular lighting bar of claim 5, wherein the mounting bar further comprises at least one cylindrical recess on at least one of the two side surfaces of the mounting bar that internally connects to a corresponding member-receiving recess;

the at least one member-receiving recess is sufficiently wide to allow the member to pivot within the member-receiving recess; and further comprising at least one rotating cylindrical plug disposed in the at least one cylindrical recess and having a means for securely receiving the end of the at least one member.

8. The modular lighting bar of claim 7, further comprising at least one cap dimensioned to cover an end of the at least one cylindrical recess.

9. The modular lighting bar of claim 5, wherein the at least one light recess and at least one member-receiving recess respectively further comprise symmetrically spaced pluralities of light recesses and member-receiving recesses.

10. The modular lighting bar of claim 1, wherein the mounting bar and the housing together serve as a hand rail mounting base.

11. The modular lighting bar of claim 1, wherein the supply recess is mateable with the electrical supply line in only one possible orientation.

12. The modular lighting bar of claim 1, further comprising at least one miniature light assembly including a light source enclosed in a light housing and a positive prong and a negative prong supplying power to the light source protruding from the light housing.

13. The modular lighting bar of claim 12, wherein the light source is an LED.

14. The modular lighting bar of claim 1, composed of at least one of the materials selected from the group consisting of metal, wood and plastic.

15. The modular lighting bar of claim 1, wherein the mounting bar and housing each include at least one section that is straight or curved.

16. The modular lighting bar of claim 1, wherein the mounting bar and housing include at least one articulating segments.

17. A modular lighting bar, comprising:

a housing having a length, a width, and a supply recess along the length of the housing dimensioned to receive an electrical supply line having a positive lead and a negative lead; and a mounting bar having a top surface, a bottom surface and two side surfaces, and including a housing recess along the top surface dimensioned to receive the housing and orient the electrical supply line therebetween, at least one light recess on the bottom surface for receiving a miniature light assembly, the least one light recess dimensioned and positioned such that a positive prong and negative prong of a light assembly disposed in the at least one light recess makes electrical contact with the corresponding positive and negative lead of the electrical supply line, and at least one member-receiving recess on the top surface of the mounting bar dimensioned to receive an end of at least one member.

18. The modular lighting bar of claim 17, wherein the at least one member is a baluster.

19. The modular lighting bar of claim 17, wherein the mounting bar further comprises at least one cylindrical recess on at least one of the two side surfaces of the mounting bar that internally connects to a corresponding member-receiving recess;

the at least one member-receiving recess is sufficiently wide to allow the member to pivot within the member-receiving recess; and further comprising at least one rotating cylindrical plug disposed in the at least one cylindrical recess and having a means for securely receiving the end of the at least one member.

20. The modular lighting bar of claim 19, further comprising at least one cap dimensioned to cover an end of the at least one cylindrical recess.

21. The modular lighting bar of claim 17, wherein the at least one light recess and at least one member-receiving recess respectively further comprise symmetrically spaced pluralities of light recesses and member-receiving recesses.

22. The modular lighting bar of claim 17, wherein the mounting bar and the housing together serve as a hand rail mounting base.

23. The modular lighting bar of claim 17, wherein the supply recess is mateable with the electrical supply line in only one possible orientation.

24. The modular lighting bar of claim 17, further comprising at least one miniature light assembly including a light source enclosed in a light housing and a positive prong and a negative prong for supplying power to the light source protruding from the light housing.

25. The modular lighting bar of claim 24, wherein the light source is an LED.

26. The modular lighting bar of claim 17, composed of at least one material selected from the group consisting of metal, wood and plastic.

27. The modular lighting bar of claim 17, wherein the mounting bar and the housing include at least one section having a shape selected from the group consisting of straight and curved.

28. The modular lighting bar of claim 17, wherein the mounting bar and the housing each include at least one articulating segments.

29. A modular lighting bar, comprising:

a mounting bar having a top surface, a bottom surface, two side surfaces and two ends, and including an internal supply recess dimensioned to receive and to orient a pair of electrical supply lines within the mounting bar in a predetermined orientation to establish a specific polarity, at least one light recess on the bottom surface for receiving a miniature light assembly, the at least one light recess being dimensioned and positioned to receive a light assembly in only a predetermined orientation such that a positive prong and negative prong of a light assembly disposed in the at least one light recess makes electrical contact with corresponding positive and negative leads of the electrical supply lines, a male connector at one of the two ends, and a corresponding female connector at the other of the two ends.

30. The modular lighting bar of claim 29, further comprising means for fastening the mounting bar to a surface.

31. The modular lighting bar of claim 29, wherein the mounting bar further comprises at least one through hole extending through the mounting bar through which the modular lighting bar is fastenable to a surface.

32. The modular lighting bar of claim 29, wherein the male connector and the female connector comprise interlocking dovetail connectors.

33. The modular lighting bar of claim 29, wherein the mounting bar further comprises at least one member-receiving recess on the bottom surface dimensioned to receive an end of at least one member.

34. The modular lighting bar of claim 33, wherein the at least one member is a baluster.

35. The modular lighting bar of claim 33, wherein the mounting bar further comprises at least one cylindrical recess on at least one of the two side surfaces of the mounting bar that internally connects to a corresponding member-receiving recess;

the at least one member-receiving recess is sufficiently wide to allow the member to pivot within the member-receiving recess; and further comprising at least one rotating cylindrical plug disposed in the at least one cylindrical recess and having a means for securely receiving the end of the at least one member.

36. The modular lighting bar of claim 35, further comprising at least one cap dimensioned to cover an end of the at least one cylindrical recess.

37. The modular lighting bar of claim 29, further comprising at least one miniature light assembly including a light source enclosed in a light housing and a positive prong and a negative prong supplying power to the light source.

38. The modular lighting bar of claim 29, wherein the mounting bar includes at least one section that is of a shape selected from the group consisting of straight or curved.

39. The modular lighting bar of claim 29, wherein the mounting bar includes at least one articulating segment.

40. A modular lighting bar, comprising:

a mounting bar having a top surface, a bottom surface and two side surfaces, and including an internal supply recess dimensioned to receive and to orient an electrical supply line in only one possible orientation within the mounting bar, at least one light recess on the bottom surface for receiving a miniature light assembly, the at least one light recess dimensioned and positioned such that a positive prong and negative prong of a light assembly disposed in the at least one light recess makes electrical contact only with corresponding positive and negative leads of the electrical supply line, and at least one member-receiving recess on the bottom surface dimensioned to receive an end of at least one member.

41. The modular lighting bar of claim 40, wherein the at least one member is a baluster.

42. The modular lighting bar of claim 40, wherein the mounting bar further comprises at least one cylindrical recess on at least one of the two side surfaces of the mounting bar that internally connects to a corresponding member-receiving recess;

the at least one member-receiving recess is sufficiently wide to allow the member to pivot within the member-receiving recess; and further comprising at least one rotating cylindrical plug disposed in the at least one cylindrical recess and having a means for securely receiving the end of the at least one member.

43. The modular lighting bar of claim 42, further comprising at least one cap dimensioned to cover an end of the at least one cylindrical recess.

44. The modular lighting bar of claim 40, wherein the at least one light recess and at least one member-receiving recess respectively further comprise symmetrically spaced pluralities of light recesses and member-receiving recesses.

45. The modular lighting bar of claim 40, wherein the supply recess is mateable with the electrical supply line in only one possible orientation.

46. The modular lighting bar of claim 40, further comprising at least one miniature light assembly including a light source enclosed in a light housing and a positive prong and a negative prong supplying power to the light source protruding from the light housing.

47. The modular lighting bar of claim 40, wherein the mounting bar includes at least one section that is straight or curved.

48. The modular lighting bar of claim 17, wherein the mounting bar includes at least one articulating segment.

49. A railing system including at least one modular lighting bar as in claim 1.

50. A railing system including at least one modular lighting bar as in claim 17.

51. The railing system of claim 50, wherein a pair of lighting bars comprise segments of top and bottom rails, respectively, each holding opposite ends of at least one baluster.

52. A railing system including at least one modular lighting bar as in claim 29.

53. A railing system including at least one modular lighting bar as in claim 40.

54. The railing system of claim 53, wherein a pair of lighting bars comprise segments of top and bottom rails, respectively, each holding opposite ends of at least one baluster.

* * * * *